US009120534B1

(12) United States Patent
Corn

(10) Patent No.: US 9,120,534 B1
(45) Date of Patent: Sep. 1, 2015

(54) ASSEMBLY AND METHOD TO ATTACH A DEVICE SUCH AS A HYDROFOIL TO AN ANTIVENTILATION PLATE

(71) Applicant: James F. Corn, Kearney, MO (US)

(72) Inventor: James F. Corn, Kearney, MO (US)

(73) Assignee: Sport Marine Technologies, Inc., Pilot Point, TX (US)

( * ) Notice: Subject to any disclaimer, the term of this patent is extended or adjusted under 35 U.S.C. 154(b) by 0 days.

(21) Appl. No.: 14/149,880

(22) Filed: Jan. 8, 2014

Related U.S. Application Data

(63) Continuation-in-part of application No. 13/658,907, filed on Oct. 24, 2012, which is a continuation-in-part of application No. 13/066,288, filed on Apr. 11, 2011, now Pat. No. 8,636,553, which is a continuation-in-part of application No. 12/150,598, filed on Apr. 29, 2008, now Pat. No. 8,043,135.

(51) Int. Cl.

| | |
|---|---|
| ***B63H 1/18*** | (2006.01) |
| ***B63H 1/28*** | (2006.01) |
| ***B63H 5/16*** | (2006.01) |
| ***B63B 1/24*** | (2006.01) |
| ***B63B 17/00*** | (2006.01) |

(52) U.S. Cl.
CPC ..... *B63B 1/242* (2013.01); *B63B 17/00* (2013.01)

(58) Field of Classification Search
CPC ..... B63B 1/00; B63B 1/16; B63B 1/20; B63B 1/24; B63B 1/242; B63B 17/00; B63B 5/00; B63B 5/04; B63H 5/16; B63H 21/26; B63H 21/30; B63H 2020/00
USPC ..... 440/53, 66, 71, 72, 76; 114/274
See application file for complete search history.

(56) References Cited

U.S. PATENT DOCUMENTS

| | | | |
|---|---|---|---|
| 1,226,400 | A | 5/1917 | Smith |
| 2,319,640 | A | 5/1943 | Sink |

(Continued)

FOREIGN PATENT DOCUMENTS

| | | |
|---|---|---|
| GB | 716879 | 10/1954 |
| SE | 226596 | 5/1969 |
| WO | 2007047257 | 4/2007 |

OTHER PUBLICATIONS

Item 1, Marine Dynamics, Inc. 2009 Catalog, 16 pgs.

(Continued)

*Primary Examiner* — Daniel V Venne
(74) *Attorney, Agent, or Firm* — Law Office of William Gustavson, PC

(57) ABSTRACT

An assembly (300), including a hydrofoil (302), is provided for mounting on the anti-ventilation plate (14) of a sterndrive or outboard motor (16) without the need to modify the plate or motor. The hydrofoil (302) of the assembly (300) has a series of holes (308) spaced along its width to receive a series of mounting disk assemblies (304) having a stepped disk (310). A carriage bolt (314) forming a part of each mounting disk assembly (304) is placed in the hole (308) closest the edge (36, 38) of the plate (14), a stepped disk (310) is placed over the end of the bolt (314) and the hydrofoil (302) is clamped on the plate (14) by tightening nuts (316) to clamp the plate (14) between the hydrofoil (302) and step (362) of the disk (310). Friction material (312) on the mounting disk assemblies provides firm engagement with the plate (14). A catch (206) can be mounted between the hydrofoil (302) and the trim tab or anode recess (76) in the plate (14).

19 Claims, 28 Drawing Sheets

(56) References Cited

U.S. PATENT DOCUMENTS

| | | | | |
|---|---|---|---|---|
| 2,963,000 | A | | 12/1960 | Fester |
| 2,983,246 | A | | 5/1961 | Manley |
| 2,998,795 | A | | 9/1961 | Downie et al. |
| 3,035,538 | A | | 5/1962 | Willard |
| 3,099,240 | A | | 7/1963 | Montague, Jr. |
| 3,114,343 | A | | 12/1963 | Headrick et al. |
| 3,139,853 | A | | 7/1964 | McCarthy et al. |
| 3,209,716 | A | | 10/1965 | Hartley |
| 3,211,119 | A | | 10/1965 | Kiekhaefer |
| 3,343,512 | A | | 9/1967 | Ramussen |
| 3,433,195 | A | | 3/1969 | Poole |
| 3,765,356 | A | | 10/1973 | Cook |
| 3,817,202 | A | | 6/1974 | Holtermann |
| 3,955,527 | A | | 5/1976 | Holtermann |
| 3,964,417 | A | | 6/1976 | Williams et al. |
| 4,040,373 | A | | 8/1977 | Jones, Jr. |
| 4,100,876 | A | | 7/1978 | Feleus |
| 4,205,618 | A | | 6/1980 | Olsson |
| 4,304,557 | A | | 12/1981 | Henrich |
| 4,323,355 | A | | 4/1982 | Kondo |
| D271,582 | S | | 11/1983 | Knowles |
| 4,487,152 | A | | 12/1984 | Larson |
| 4,597,742 | A | | 7/1986 | Finkl |
| 4,637,801 | A | | 1/1987 | Schultz |
| 4,680,017 | A | | 7/1987 | Eller |
| 4,708,672 | A | | 11/1987 | Bentz et al. |
| 4,738,644 | A | | 4/1988 | Happel |
| 4,744,779 | A | | 5/1988 | Koehler |
| 4,756,265 | A | | 7/1988 | Lane |
| 4,832,634 | A | | 5/1989 | Kearns |
| D307,130 | S | | 4/1990 | Ellis |
| D308,851 | S | | 6/1990 | Templeman |
| D311,513 | S | | 10/1990 | Templeman |
| 4,968,275 | A | | 11/1990 | Carlson |
| 4,977,847 | A | | 12/1990 | Bartlett |
| 4,995,840 | A | | 2/1991 | Seale et al. |
| 5,048,449 | A | | 9/1991 | Templeman |
| 5,107,786 | A | | 4/1992 | Templeman |
| D328,732 | S | | 8/1992 | Whitley, II |
| 5,138,966 | A | | 8/1992 | Whitley, II |
| D331,738 | S | | 12/1992 | Simpson |
| 5,178,089 | A | * | 1/1993 | Hodel ..... 114/274 |
| 5,203,275 | A | | 4/1993 | Brauner et al. |
| 5,231,950 | A | | 8/1993 | Poulos |
| 5,307,754 | A | | 5/1994 | Leonardis |
| D351,129 | S | | 10/1994 | Templeman |
| D352,023 | S | | 11/1994 | Corn |
| 5,396,860 | A | | 3/1995 | Cheng |
| 5,425,663 | A | | 6/1995 | Meisenburg et al. |
| D363,914 | S | | 11/1995 | Corn |
| 5,493,990 | A | | 2/1996 | Dyer |
| 5,588,390 | A | | 12/1996 | French |
| 5,638,765 | A | | 6/1997 | Poulos |
| 5,673,643 | A | | 10/1997 | Poppa |
| 5,848,922 | A | | 12/1998 | Itima et al. |
| 6,503,110 | B2 | | 1/2003 | Lammli |
| D487,245 | S | | 3/2004 | Geriene et al. |
| D492,242 | S | | 6/2004 | Geriene et al. |
| 6,948,441 | B2 | | 9/2005 | Levine |
| 7,011,559 | B1 | | 3/2006 | Moldenhauer |
| D533,497 | S | | 12/2006 | Templeman |
| 7,232,355 | B2 | | 6/2007 | Woolley |
| 7,270,584 | B1 | | 9/2007 | Mitchell |
| D589,866 | S | | 4/2009 | Templeman et al. |
| D590,760 | S | | 4/2009 | Templeman et al. |
| 7,520,238 | B2 | | 4/2009 | Patterson |
| D591,664 | S | | 5/2009 | Corn |
| 7,568,443 | B2 | | 8/2009 | Walker |
| D615,475 | S | | 5/2010 | Corn |
| D640,179 | S | | 6/2011 | Corn |
| 8,043,135 | B1 | | 10/2011 | Corn |
| 8,302,549 | B2 | | 11/2012 | Templeman et al. |
| 8,312,831 | B2 | | 11/2012 | Templeman et al. |
| 8,636,553 | B1 | | 1/2014 | Corn |
| 2009/0314195 | A1 | | 12/2009 | Templeman et al. |
| 2011/0315063 | A1 | | 12/2011 | Templeman et al. |

OTHER PUBLICATIONS

Item 2, Marine Dynamics, Inc. Catalog dated prior to 2009, 14 pgs.
Item 3, U.S. Appl. No. 60/728,345 filed Oct. 19, 2005, Inventor Templeman, 12 pgs.
Item 4, Photograph of Cobra Edge device. The Cobra Edge device was commercially available in U.S. prior to 2010.
Item 5, Two Photographs of modified Cobra Edge device downloaded from Internet, believed to have been uploaded to the Internet on May 14, 2009.
Item 6A, Photographs of Turbo Lift device, Item 6B brochure of Turbo Lift device 4 pgs. and Item 6C, photographs and text. 16 pgs, of Turbo Lift device. The Turbo Lift device was commercially available in U.S. prior to 2010.
Item 7A brochure Aug. 2005, 2 pgs, of Whale Tail device, and Item 7B photograph of Whale Tail device. The Whale Tail device was commercially available in U.S. prior to 2010.
Screen shot from Internet of Perma Trim device. The Perma Trim device was commercially available in U.S. prior to 2010.
A page from Marine Industrial Supply catalog dated prior to 2010.
Page 299 from Coast Distributors catalog dated prior to 2010.
Portion of front of package insert, XRIII hydrofoil, dated 2007 from Marine Dynamics, Inc.
Portion of back of package insert, XRIII hydrofoil, dated 2007 from Marine Dynamics, Inc.
Internet catalog of Marine Dynamics, Inc. downloaded 2008.
Ad from Marine Dynamics, Inc., date unknown.
Advertisement, Sting Ray Hydrofoil Stabilizer, IMTEC 1994.
Article, Build Your Own Ski Boat, Waterski, Nov./Dec. 1994, Author Pierce Hoover.
Advertisement, Doel-fin Boat Stabilizer, Doelcher Products, Inc., 1979.
Article, Doel fin Not Just Another Gadget, Jul. 1979.
Advertisement, Break Through of Doel fin Stabilizer, 1979.
Article, Hydrofoils: How Good Are They? Trailer Boats, Apr. 1994; cover, pp. 64-69.
Article, Hydrofoils: How Good Are They? by Jim Barron, 1994.
Advertisement, Hydrofoil G.T., Hydrofoil International Corp., 1994.
Advertisement, Sting Ray Hydrofoil Stabilizer, 1988, Marine Dynamics, Inc.
Advertisement, Trailer Boats, p. 130 Sting Ray Hydrofoil Stabilizer, 1988.
Advertisement, Bass Pro, p. 100, 1988.
Advertisement, p. 36, 1991.
Article, Rig for Range by John L. Beath, Trailer Boats, May 31, 2005.
Article, Fin Fight by Jim Barron, Bass & Walleye Boats, Winter 1994 pp. 40-43.
Article, 10 Cures for Poor Holeshot by John Tiger, Jr., Bass & Walleye Boats, Feb. 2000, pp. 54-56.
Ad from Cabella's website for XR High Performance Hydrofoil Stabilizer, downloaded from Internet early 2006.
Tech Letter re SE Sport hydrofoil, Trailer Boats, Aug. 2005, p. 76.
Ad, SE Sport hydrofoil, Go Boating, Apr. 2005, p. 36.
Ad, XR hydrofoil, Boating Life, Feb. 2006, p. 94.
Atlantic Watercraft, Inc. Catalog entitled "Revised IMTEC Edition", Published 1994, Place of Publication United States.
Advertisement, Doel-fin Boat Stabilizer, Doelcher Products, p. 5, Bass & Walleye Boat Magazine, Published Oct. 1994, Place of publication United States.
Advertisement, Marine Dynmics , Inc., entitled "The Hydrofoil of Choice", p. 12, Bass & Walleye Boat Magazine, Published Oct. 1994, Place of publication United States.
Advertisement, Sport Marine Technologies, Inc., p. 82, Bass & Walleye Boat Magazine, Published Oct. 1994, Place of publication United States.

* cited by examiner

ASSEMBLY AND METHOD TO ATTACH A DEVICE SUCH AS A HYDROFOIL TO AN ANTIVENTILATION PLATE

CROSS REFERENCE TO RELATED APPLICATION

This application is a continuation in part of pending U.S. patent application Ser. No. 13/658,907 filed Oct. 24, 2012, which is a continuation in part of pending U.S. patent application Ser. No. 13/066,288 filed Apr. 11, 2011, which is a continuation in part of U.S. patent application Ser. No. 12/150,598 filed Apr. 29, 2008, now U.S. Pat. No. 8,043,135 issued Oct. 25, 2011.

TECHNICAL FIELD

This invention relates to marine operations, and in particular to a boating accessory.

BACKGROUND OF THE INVENTION

Many boaters find it desirable to mount a hydrofoil on the outboard motor or sterndrive of a pleasure boat. The hydrofoil is believed to provide enhanced efficiency and speed in boat operation. Examples of such hydrofoils are illustrated in US Design Patents D352,023 issued Nov. 1, 1994 and D363,914 issued Nov. 7, 1995, the disclosures of which is hereby incorporated by reference.

Unfortunately, the mounting of such a hydrofoil often requires a permanent modification of the outboard motor or sterndrive, such as drilling holes to receive bolts, for example. Boat owners are often reluctant to make such permanent modifications or to expend the time and effort necessary to make the modifications. A need exists to provide a more simple and effective mounting of a hydrofoil without permanent modification of the outboard motor or sterndrive.

SUMMARY OF THE INVENTION

In accordance with one aspect of the present invention, an assembly is provided for mounting to a plate on a marine component. The assembly includes a first device and at least one mounting disk assembly having a mounting disk with a step and a friction surface engaging the plate. In accordance with another aspect of the present invention, the mounting disk assembly also has a bolt to clamp the first device and mounting disk assembly to the plate at an edge thereof.

In accordance with another aspect of the present invention the assembly further has a catch secured to the first device and to the plate by the catch engaging the trim tab recess to further mount the assembly to the plate.

In accordance with another aspect of the present invention, the first device is a hydrofoil. The hydrofoil has first and second sets of apertures on both sides thereof, the aperture closest the edge of the plate in each set receiving a mounting disk assembly.

In accordance with another aspect of the present invention, four mounting disk assemblies are used to attach the hydrofoil to the plate.

BRIEF DESCRIPTION OF THE DRAWINGS

A more complete understanding of the invention and its advantages will be apparent from the following Detailed Description, taken in conjunction with the accompanying Drawings, in which.

DETAILED DESCRIPTION

With reference now to the figures, FIGS. 1-13 and, 16-18 illustrate an assembly 10 forming a first embodiment of the present invention. The assembly 10 is shown to mount a hydrofoil 12 on the anti-ventilation plate 14 (also commonly called a cavitation plate) of an outboard motor 16 without any need to modify, drill or otherwise permanently change the plate 14 or outboard motor 16. While an outboard motor 16 is shown, the assembly 10 could be used with a sterndrive (inboard/outboard). Further, while assembly 10 is shown to mount a hydrofoil, it could also mount a trolling motor or a trolling plate extending behind the propeller used to reduce thrust, or other accessory.

Figure 1:
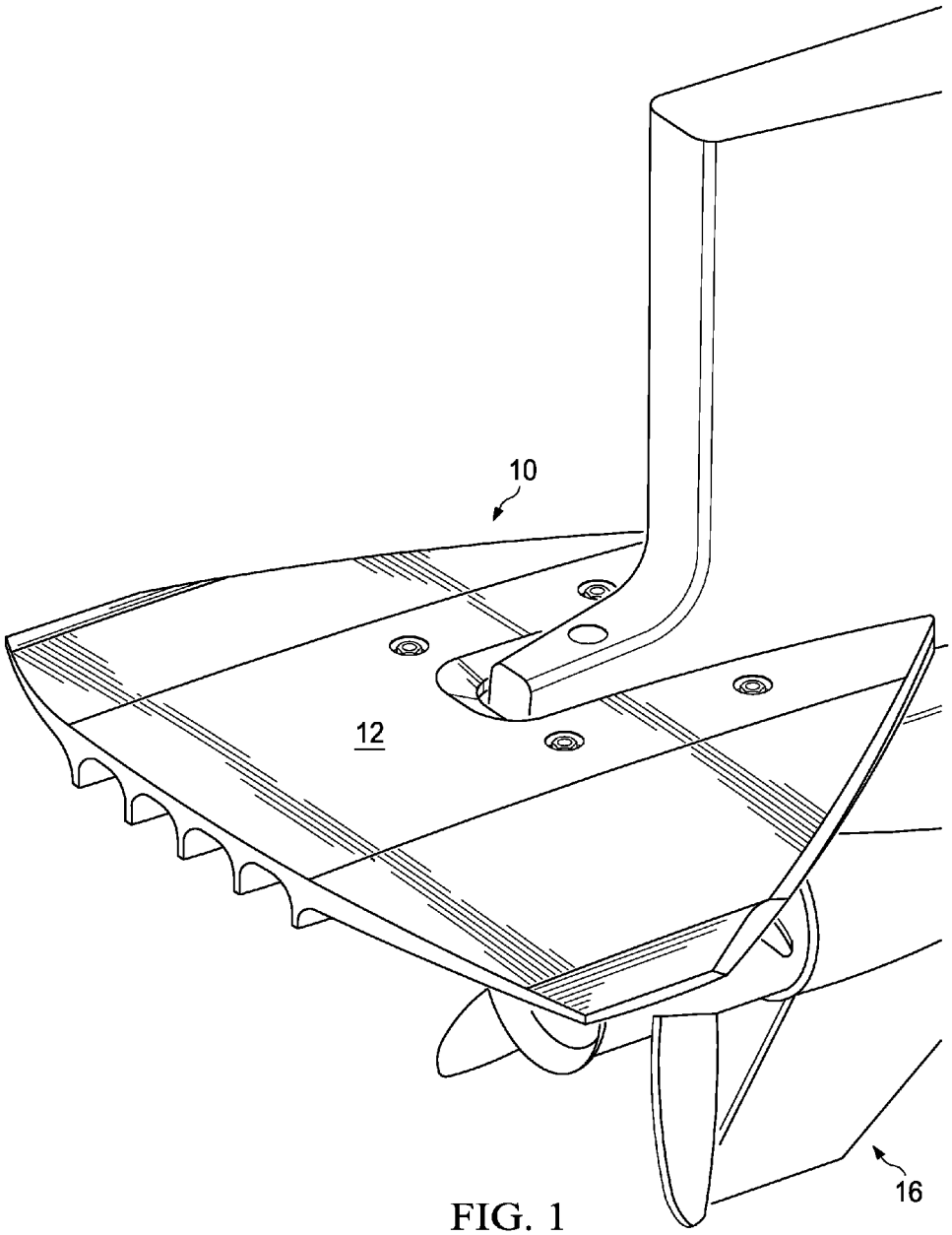
FIG. 1 is a perspective view of an assembly forming a first embodiment of the present invention mounting a hydrofoil on an outboard motor.
Figure 2:
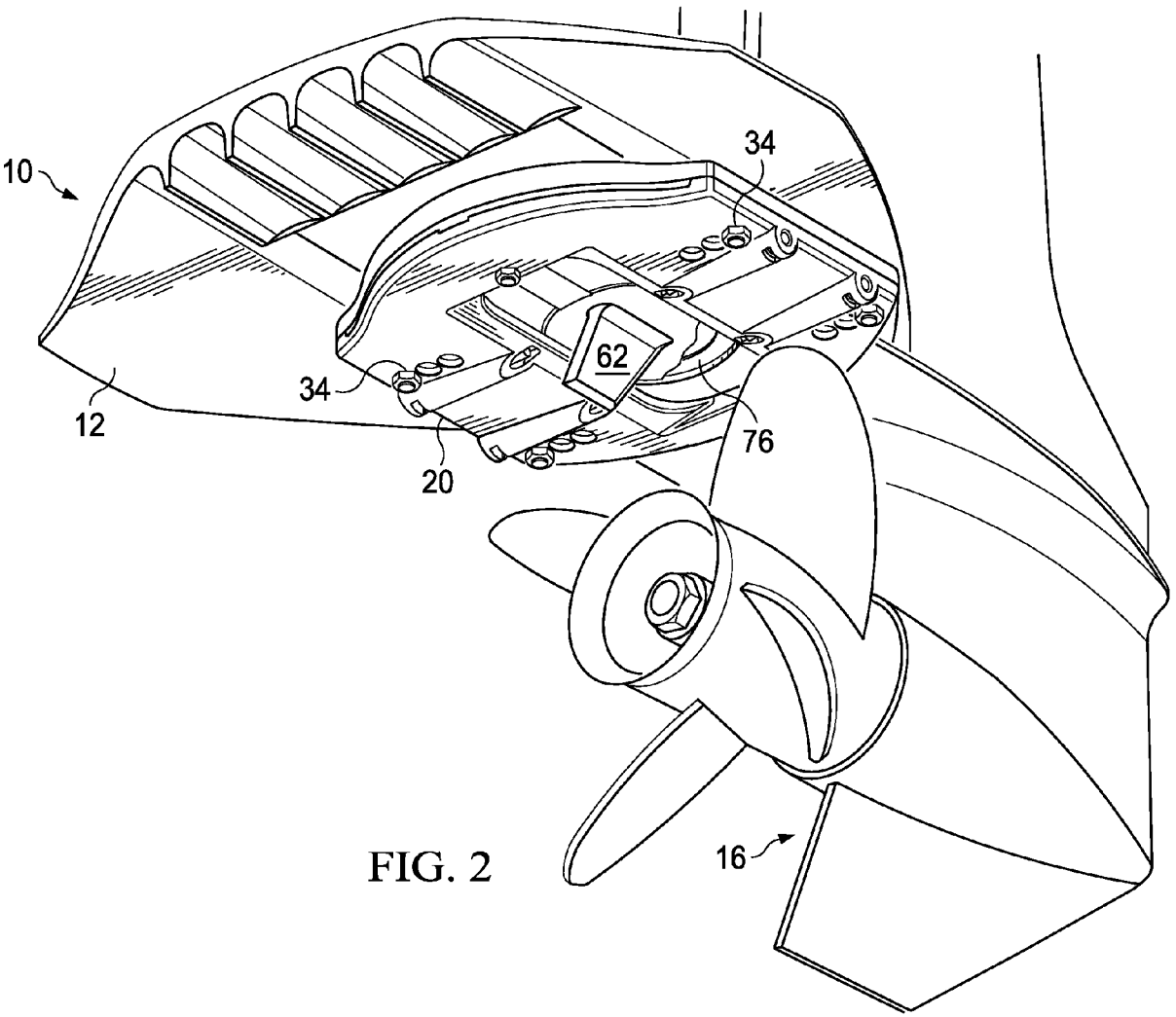
FIG. 2 is a perspective view from below of the assembly of FIG. 1.
Figure 3:
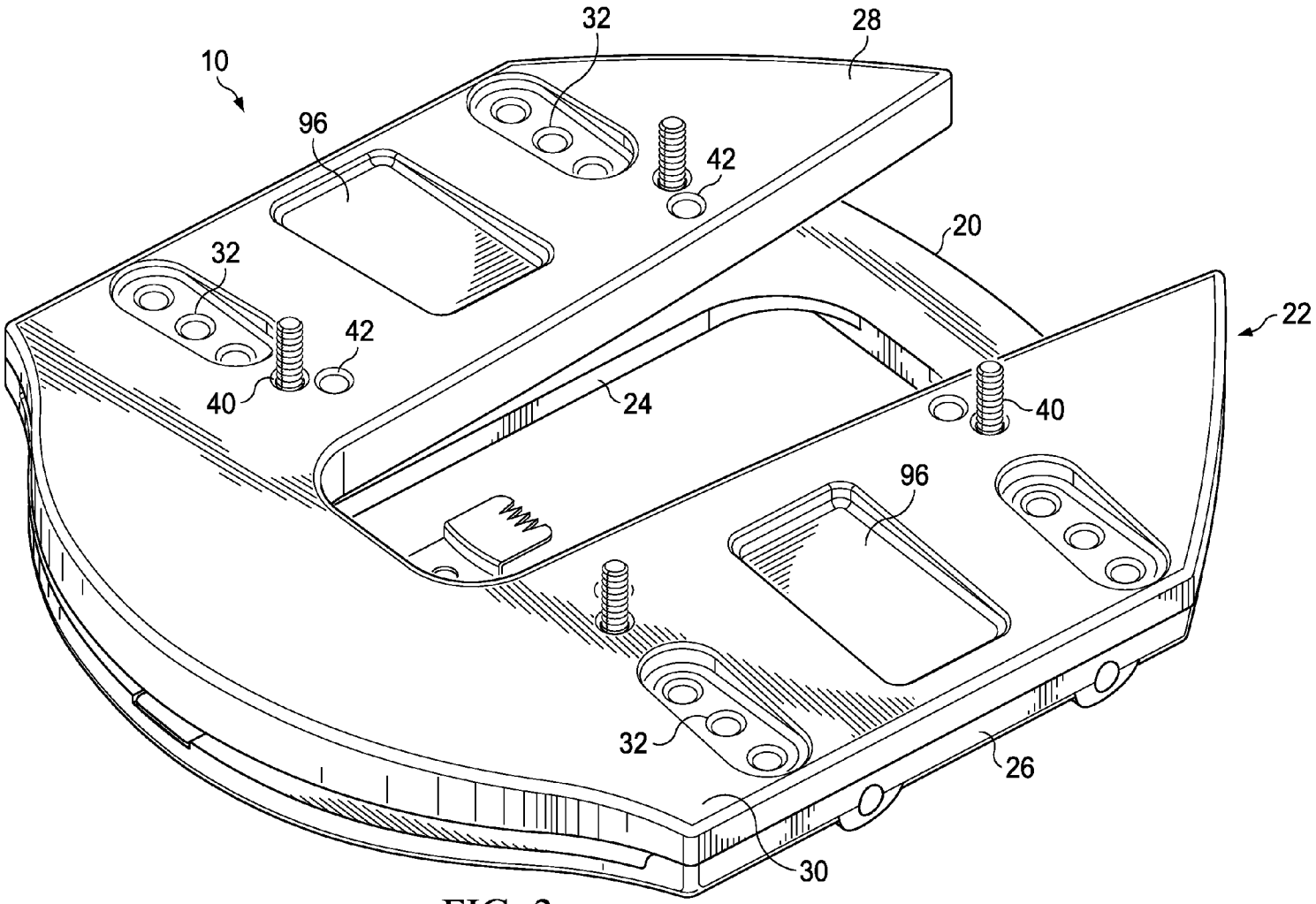
FIG. 3 is a perspective view of the assembly.
Figure 4:
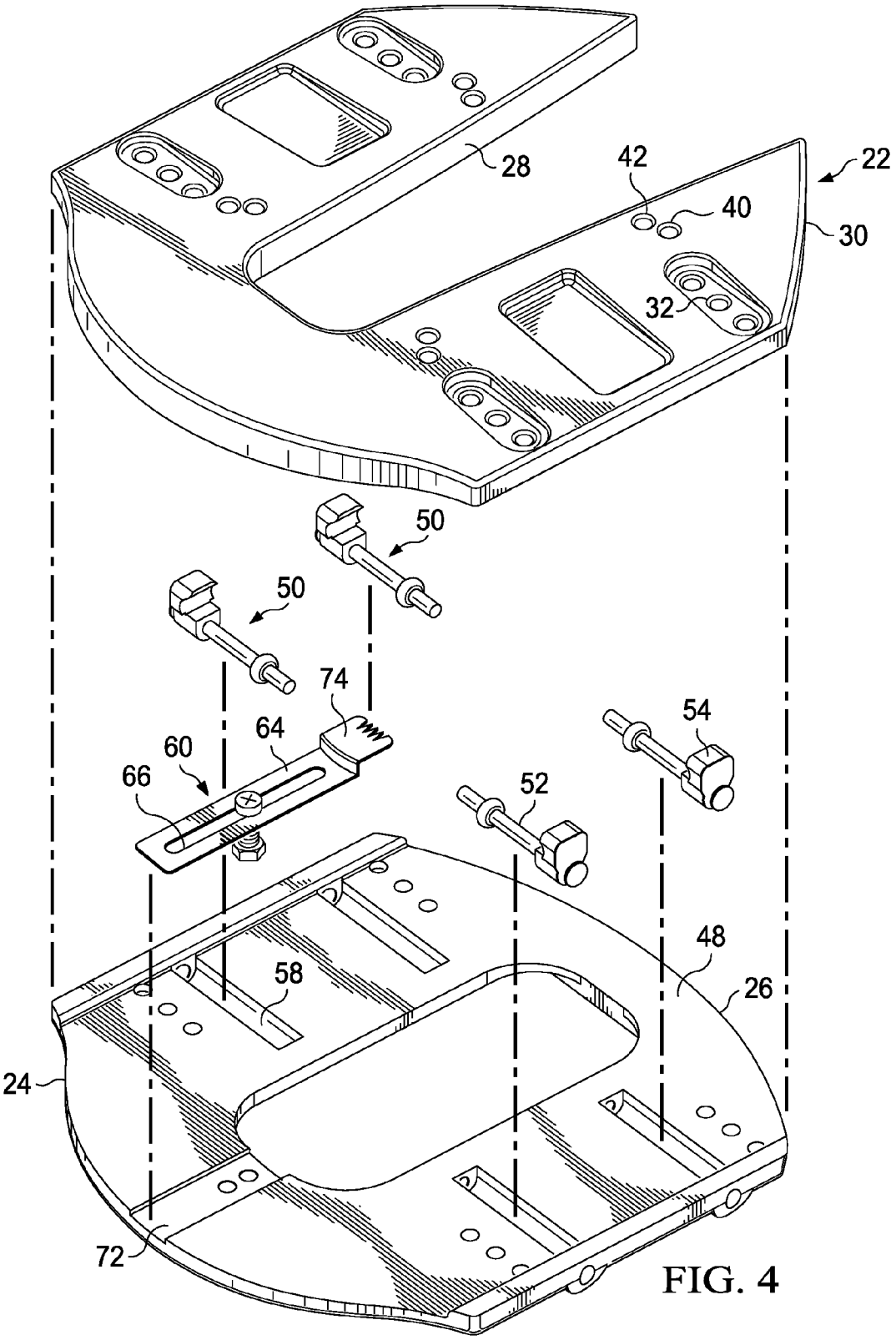
FIG. 4 is an exploded perspective view of the assembly.
Figure 5:
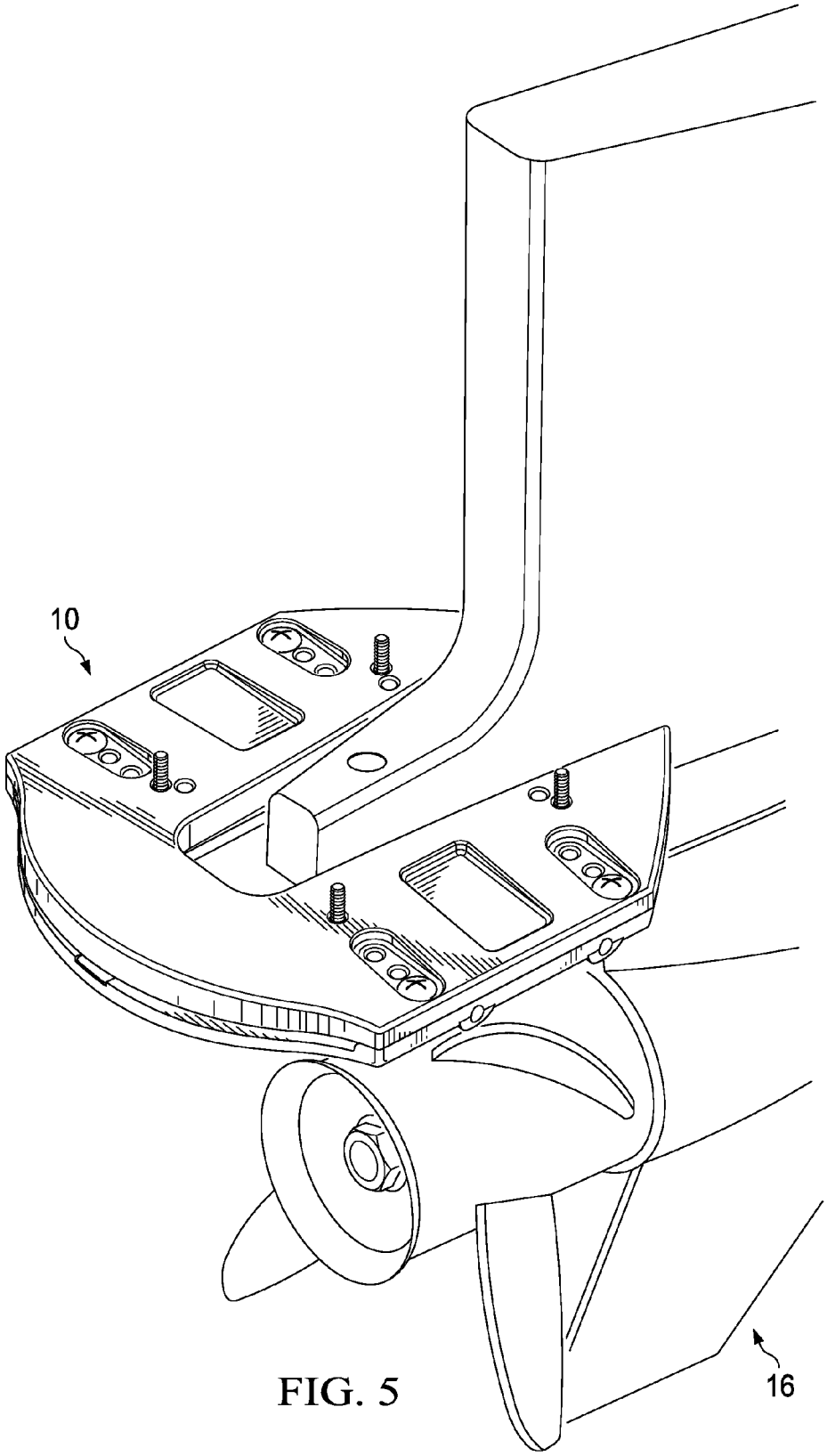
FIG. 5 is a perspective view of the assembly mounted on the outboard motor, prior to installing the hydrofoil.
Figure 7A:
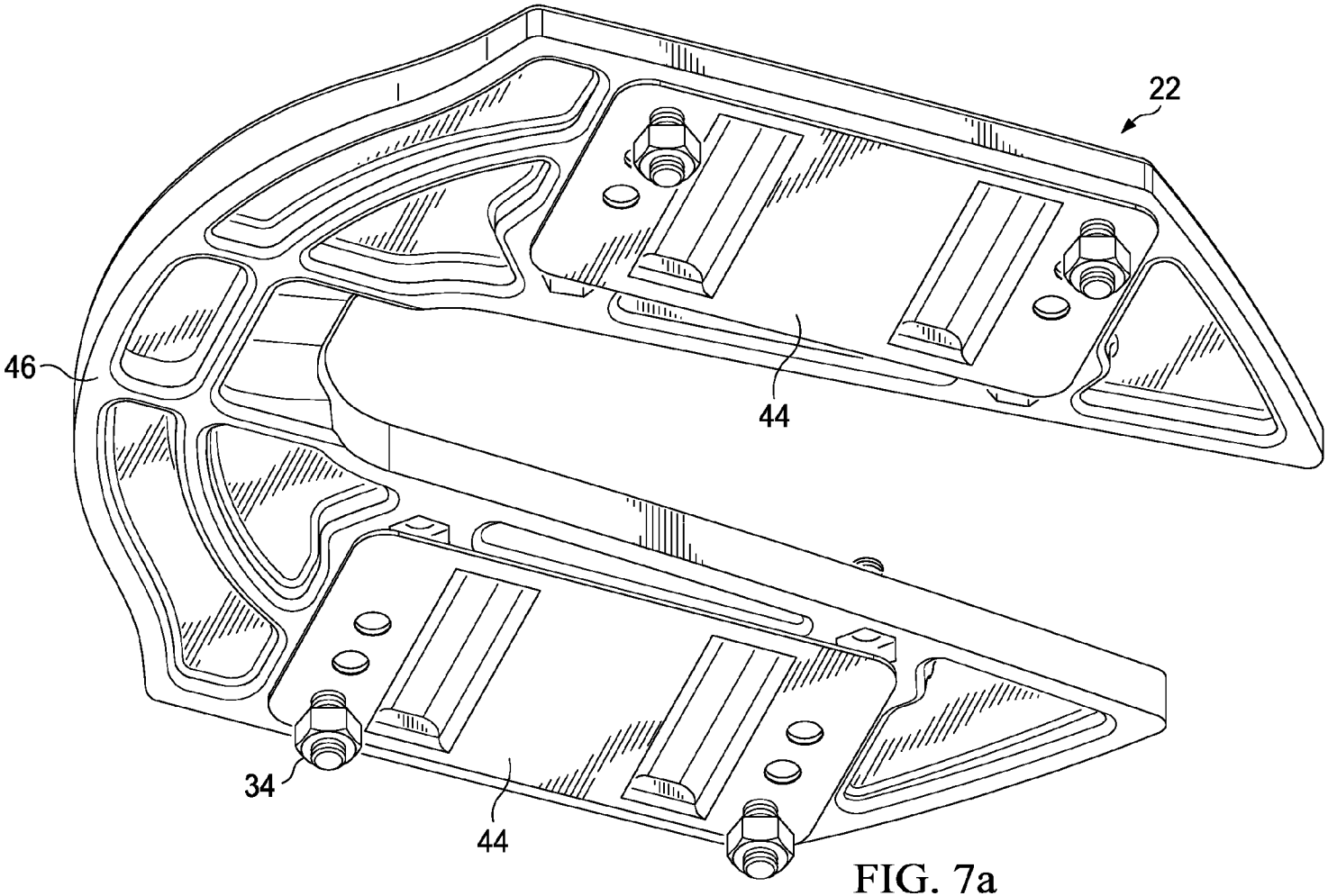
FIGS. 7*a* and 7*b* are lower and upper views respectively of the upper element of the assembly.
Figure 7B:
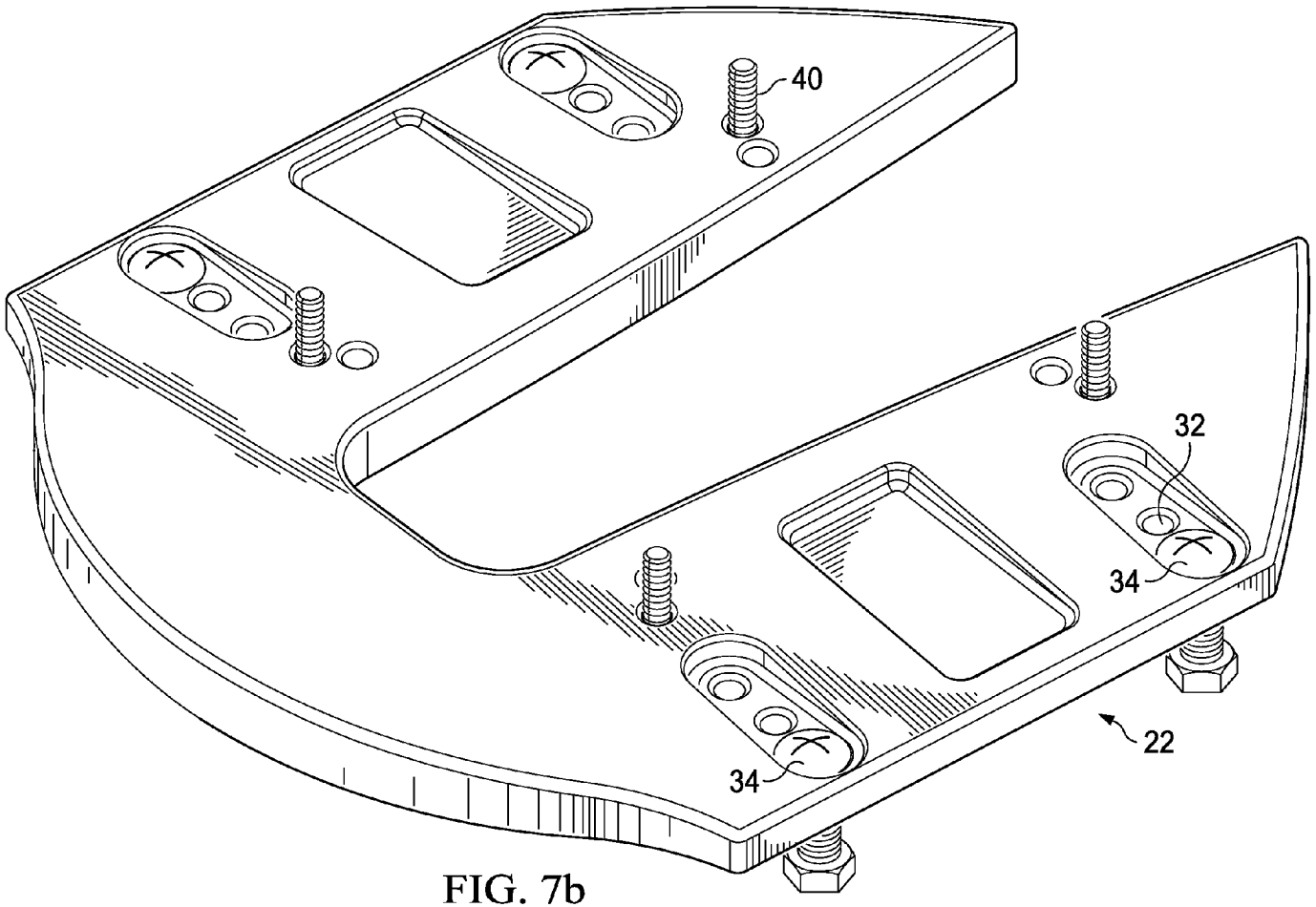
Figure 8:
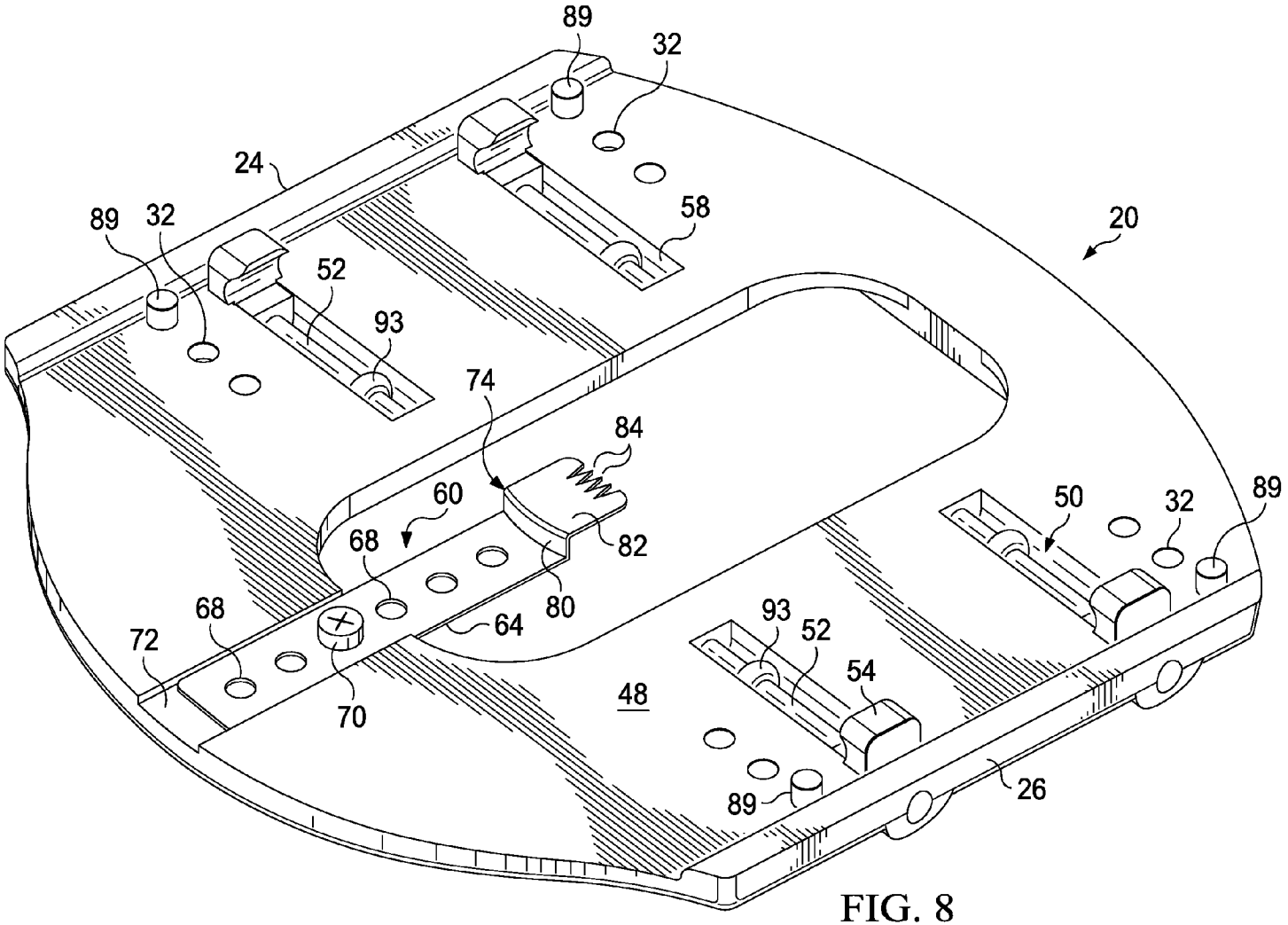
FIG. 8 is a perspective view of the lower element.
Figure 9:
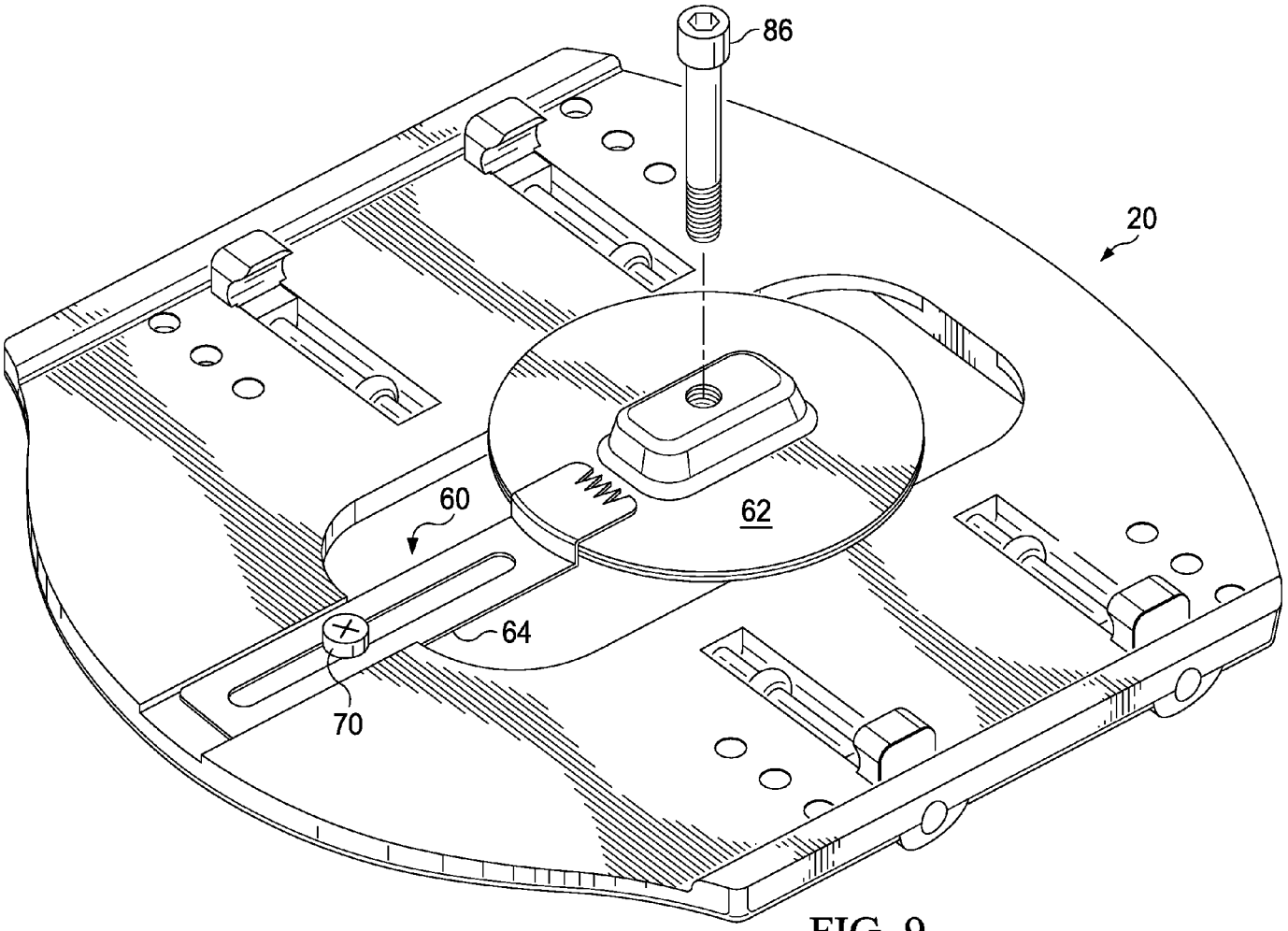
FIG. 9 is a perspective view of the lower element with a tab catch on a trim tab.
Figure 10:
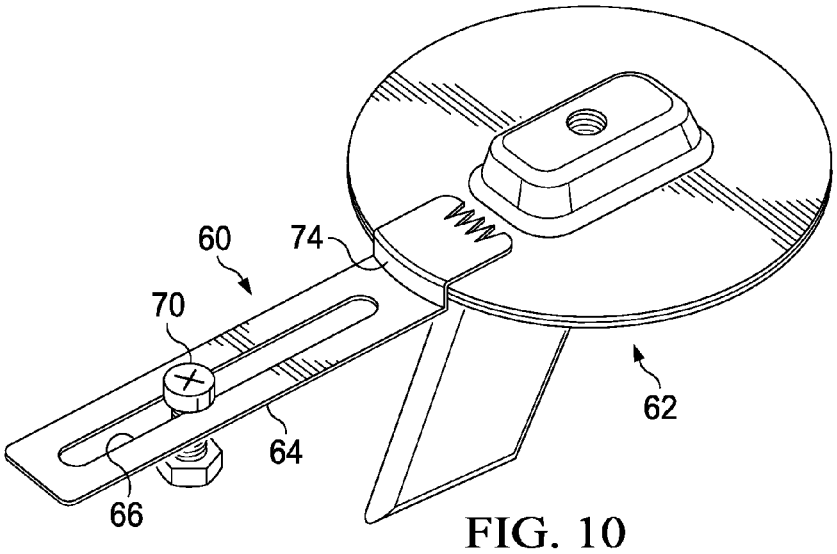
FIG. 10 is a detail perspective of the tab catch on the trim tab
Figure 11A:
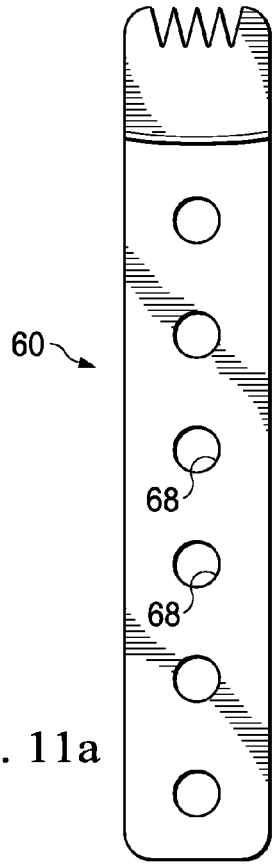
FIGS. 11*a-d* illustrate variations of the tab catch.
Figure 11B:
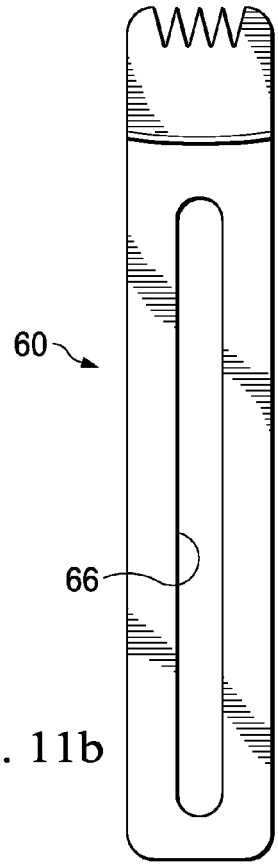
Figure 11C:
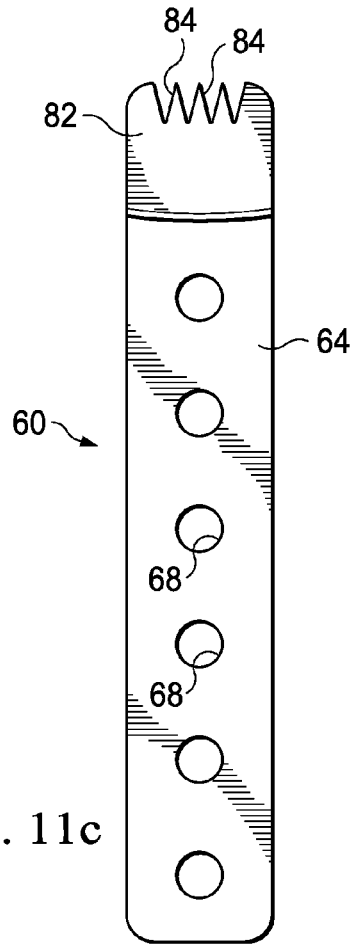
Figure 11D:
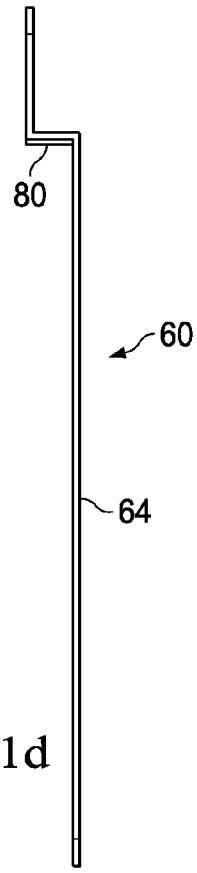
Figure 12:
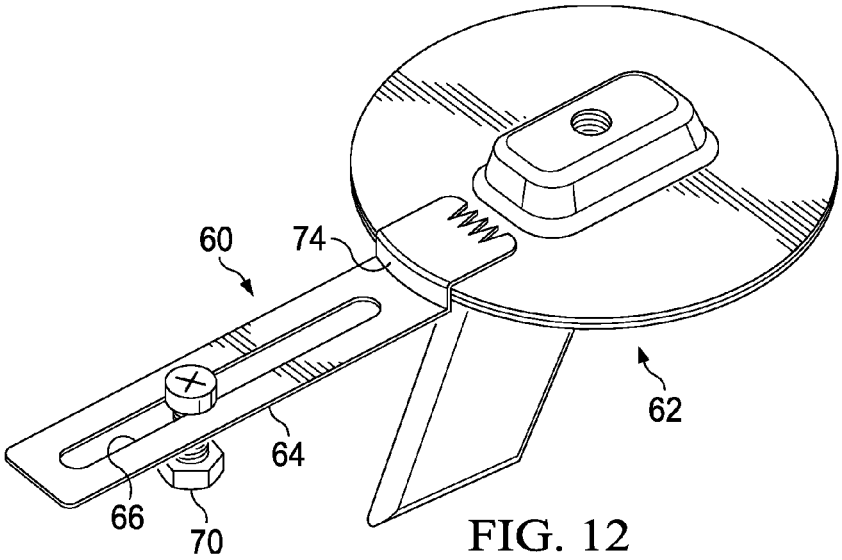
FIG. 12 is a detail perspective view of a modified tab catch having a curve.
Figure 13:
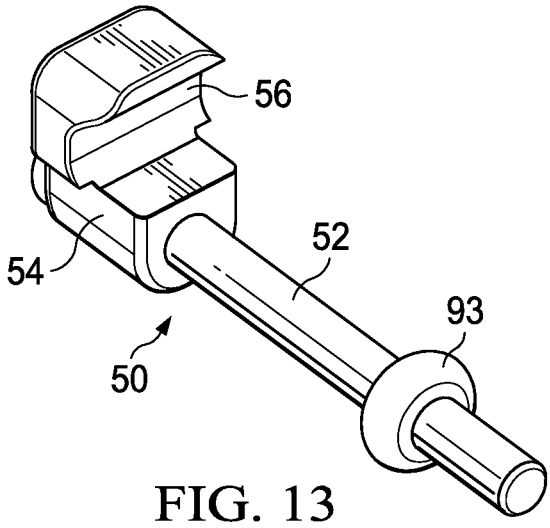
FIG. 13 is a side view of a grip used in the lower element.

With reference to FIGS. 3 and 4, the assembly 10 can be seen to include a lower element 20 and an upper element 22. The lower and upper elements 20 and 22 are preferably made of plastic, but could be made of metal, such as aluminum, or other suitable material. Each side 24 and 26 of element 20 and each side 28 and 30 of element 22 has a dual series of three inline holes 32 (four or more holes can be used, if desired) that can receive bolts 34 to secure the elements together and capture the plate 14 between the elements 20 and 22 to secure the assembly 10 to the plate 14. The holes 32 are spaced apart along the widths of the elements to match just beyond the edges 36 and 38 of various plate 14 widths. Plate 14 widths of 4, 5, 6 and 7 inches are common, for example. The bolts 34 are mounted in the holes closest to the edges 36 and 38 of the plate 14 to provide the most secure attachment. A bolt 34 is preferably mounted in each series of holes 32, for a total of four, one toward each corner of elements 20 and 22, as seen in FIG. 2. However, additional bolts 34 can be used if desired. Nylon bolt sleeves 89, as seen in FIG. 8, can be used about the portion of each bolt 34 between lower and upper elements 20 and 22 to reduce the likelihood of any damage occurring to the edges 36 and 38 of the plate 14. The upper element 22 is also provided with at least one bolt pattern 40, which matches the mounting hole pattern of many of the one piece hydrofoils on the market. A second bolt pattern 42 can also be provided for mounting a smaller foil. Additional bolt patterns can be used as necessary to adapt the assembly to the device to be attached. Preferably, the bolts used to attach the hydrofoil have flat sides, as seen in FIG. 7*a*, so that those bolts do not interfere with the attachment of the assembly 10 to the plate 14 and will not turn when the hydrofoil is installed.

Figure 18:
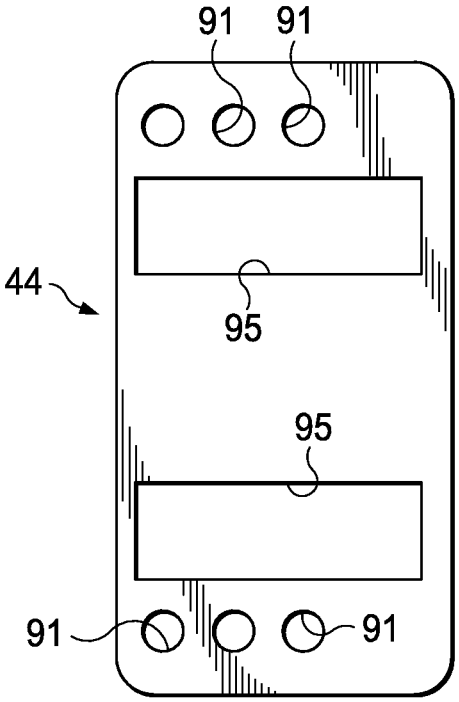
FIG. 18 is a plan view of the adhesive tape.

As the bolts 34 are tightened, the lower and upper elements 20 and 22 are compressed toward each other with the plate 14 sandwiched between, creating a sufficiently large frictional force to secure the assembly 10 on the plate 14. In most cases, the outer edges of the lower and upper elements 20 and 22 will contact each other as the bolts 34 are tightened. However, this frictional engagement can be supplemented by adhesive foam tape 44 mounted on the inside surface 46 of the upper element 22 as seen in FIGS. 7*a* and 18 which adheres to the inside surface 48 of the lower element 20 and/or to the plate 14 as the elements are compressed together. Tape 44 can be applied to the inner surface 48 of the lower element 20 also, if desired. The tape 44 has cutouts 91 aligned with the holes 32 as seen in FIG. 18. The tight compression provided by bolts 34 allows the use of both aggressive or removable adhesives.

An additional mechanism to secure assembly 10 to the plate 14 is provided by lateral grip devices 50 mounted in the lower element 20, as seen in FIGS. 4, 6, 8, 9, 13 and 17. The lower element 20 has a pair of channels 58 formed in the inside surface 48 on both sides 24 and 26. A grip device 50 is received in each channel 58 which includes a threaded rod 52 and a grip 54 threaded onto the rod 52. The rod 52 is confined in the channel 58 so that it can only be rotated about its elongate axis, but will not move along its length in the channel 58. A rubber grommet 93 can be put on the rod 52 to keep the rod 52 centered in the channel 58 and to prevent the rod from dropping out of the channel 58 when the customer starts to tighten the grip device. The grip 54 has sides that engage the walls of the channel 58 such that as the rod 52 is turned, the grip 54 translates linearly along the channel 58. One end of each of the rods 52 is exposed at the edges of the lower element 20 and has a recess to receive a screw driver (Phillips or slot, for example) to facilitate rotation of the rods 52. Each grip 54 has a U-shaped notch 56 to engage the edge 36 or 38 of the plate 14.

Figure 6:
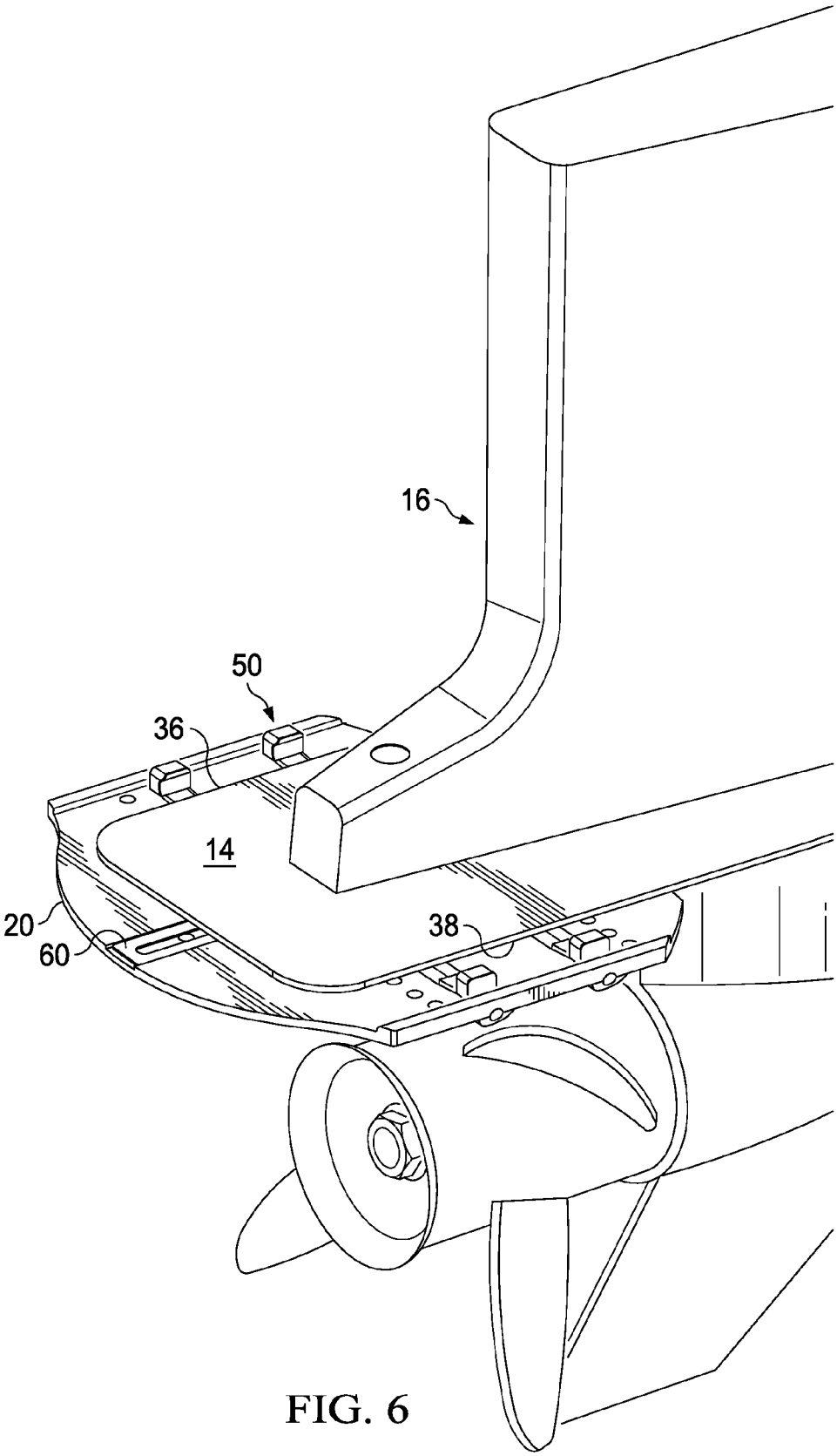
FIG. 6 is a perspective view of lower element of the assembly being mounted to the anti-ventilation plate of the outboard motor.
Figure 16:
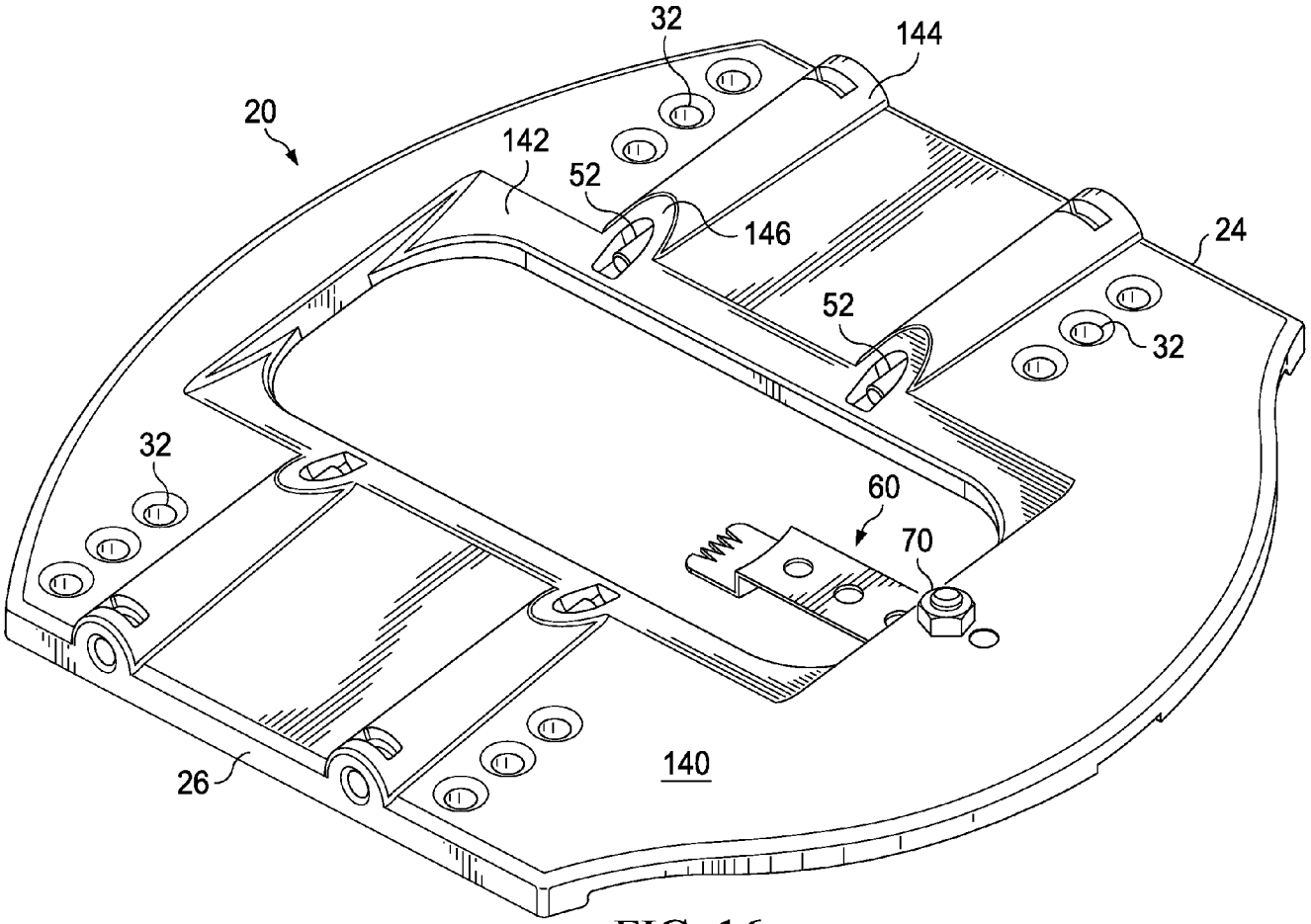
FIG. 16 is perspective view from below of the lower element.
Figure 17:
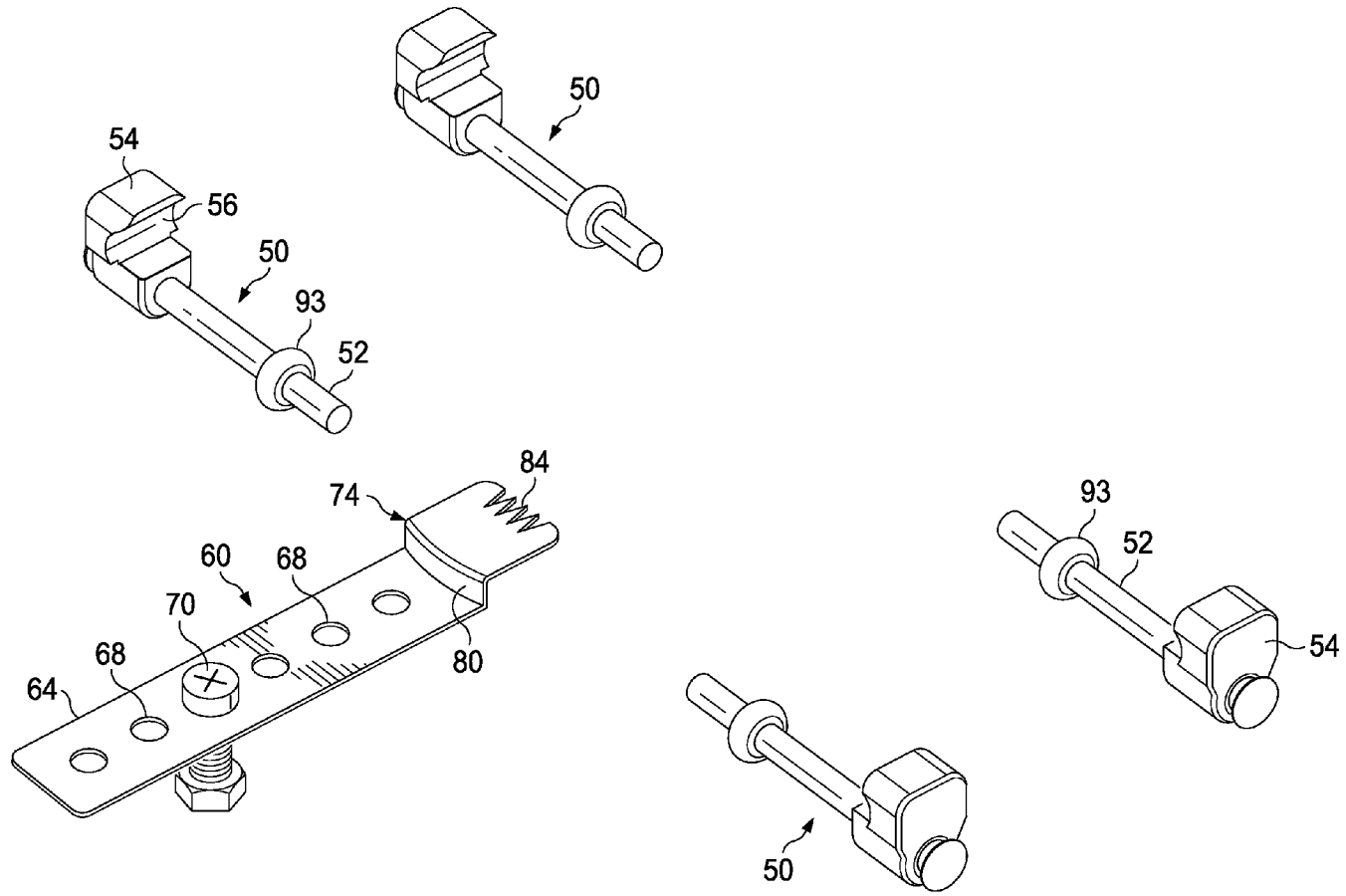
FIG. 17 is an exploded view of the grips and tab catch.

As can be seen in FIG. 6, the lower element 20 can be positioned below and in alignment with the plate 14 and the grips 54 can be tightened onto the edges 36 and 38 of the plate 14 by rotating the rods 52 from the edges of the lower element 20. As the grips 54 are tightened onto the edges 36 and 38, the notches 56 engage the edges 36 and 38 to fasten the lower element 20 to the plate 14. A perfect fit may be accomplished by alternate adjustment for each side until the lower element 20 is centered. Preferably, the grips 54 are made of a material, such as plastic, that will not mar the plate 14 as they are tightened onto the plate 14. The tape 44 has cutouts 95 as seen in FIG. 18 and the inside surface 46 of the upper element 22 can have indentions to avoid interference with the grips 54. As seen in FIG. 16, the outside surface 140 of the lower element preferably has a beveled slope surface 142 and the humps 144 defining the channels 58 has bevels 146 to provide additional clearance between the assembly 10 and the propeller, particularly where the propellers had a close clearance to the bottom of the anti-ventilation plate.

Yet another mechanism to insure secure attachment of the assembly 10 to the plate 14 is catch 60, versions of which are seen in FIGS. 3, 4, 8, 9, 10, 11*a-d*, 12 and 16-17, that cooperates with the usual trim tab 62 on the outboard motor. The catch 60 has an elongate portion 64 which has either a slot 66 as shown in the version in FIGS. 4 and 11*b*, or a series of holes 68 as shown in the version in FIGS. 8, 11*a*, 11*c*, and 11*d* to accept a bolt 70 to secure the catch 60 to the lower element 20. A slot 72 can also be formed into the inside surface 48 of the lower element 20 to keep the catch 60 in alignment. The catch 60 also has a bent portion 74 that fits into the trim tab recess 76 of motor 16, including a vertical surface 80 to engage the wall of the trim tab recess 76. The trim tab recess 76 is usually about ¼ inch deep and formed in the bottom of the anti-ventilation plate 14. The recess 76 is cylindrical and typically holds a trim tab or anode, depending on manufacturer or user preference. The recess 76 can receive, for example, a round flat sacrificial zinc anode with no steering fin. Alternatively, a trim tab, with fin, that is not made of zinc and therefore not a sacrificial anode, can be mounted in the trim tab recess. The trim tab can be made of zinc, combining the function of a trim tab and sacrificial anode. Typically, the trim tab or anode will be secured in the trim tab recess by a central bolt 86, which can inserted from the top of the trim tab recess 76 or the bottom of the trim tab recess 76, depending on the design of the plate 14. In some designs, the trim tab recess 76 can have teeth which can mesh with teeth on the trim tab to prevent the fin from turning within the recess 76 and also to allow the fin to be set at an angle from the centerline of the boat. As seen in FIGS. 11*a-d*, 12 and 17, the portion 74 can be modified by being curved at the surface 80 to enhance the ability to drop the profile into a wide range of trim tab recess diameter sizes from 2 inches to over 3 inches with as little as 0.025 inch clearance, for a one size fits all attachment which does not interfere with the tab function and attachment. The surface 80 may have a radius of curvature of 1.525 inches, for example. The trim tab or anode can simply be removed from the recess, the portion 74 placed in the recess, and the trim tab or anode then reinserted in the recess and reattached with the same bolt. The catch 60 is designed to engage only the rear ¾ inch section of the tab recess and places little stress on the tab. The catch 60 can have a thickness of only 0.025 inches. Previous designs have excessively offset the entire tab to the point it becomes insecurely attached.

Preferably, the catch 60 is made of stainless steel, but could be made of another suitable material. The trim tab 62 is shown as being attached by a single bolt 86 from above in FIG. 9. However, as noted, trim tabs can also be mounted with a bolt from below. Also, some boats may have a sacrificial anode mounted in the recess instead of a trim tab. The catch 60 will work equally well with any method of mounting a trim tab or when a sacrificial anode is used. Prior designs have attempted to remove the trim tab, and then reattach the trim tab so that it is no longer received in the recess. This has typically required obtaining a special longer bolt than used to attach the trim tab alone, creating inconvenience for the boat owner. Also, the trim tab extends down further, creating a possibility of interference with the propeller. With the trim tab extending out of the recess, it is more common for the trim tab to become loose, and it is even possible to cause the trim tab to fall off the boat. As seen in FIGS. 3, 8, 11*c*, 11*d*, and 16-17, the end 82 of the catch 60 can also have teeth 84, which can engage the teeth on the trim tab recess 76 and/or trim tab or anode, to enhance mounting.

Figure 19:
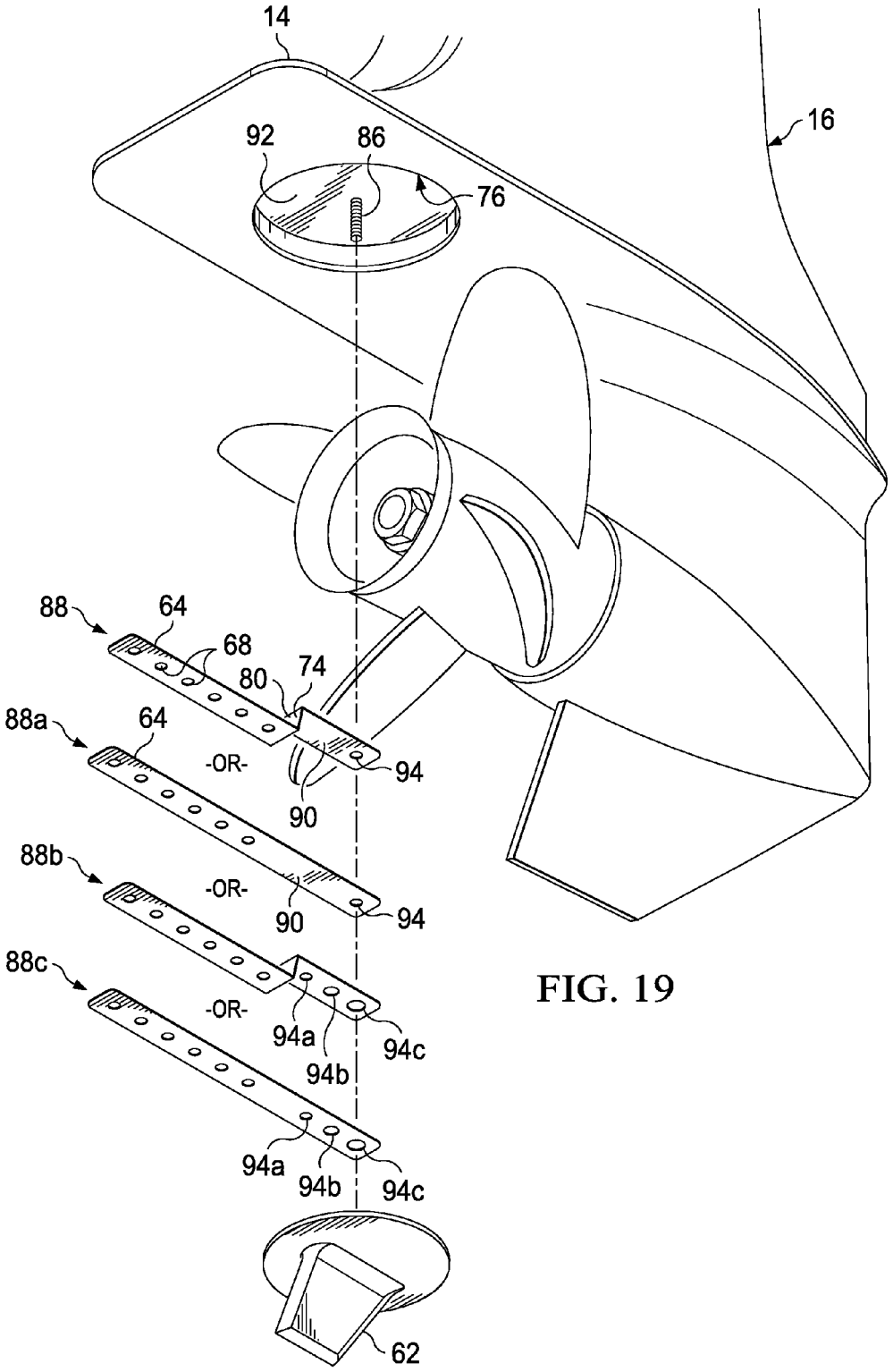
FIG. 19 is an exploded perspective view of a modified tab catch for use with an outboard motor.
Figure 20:
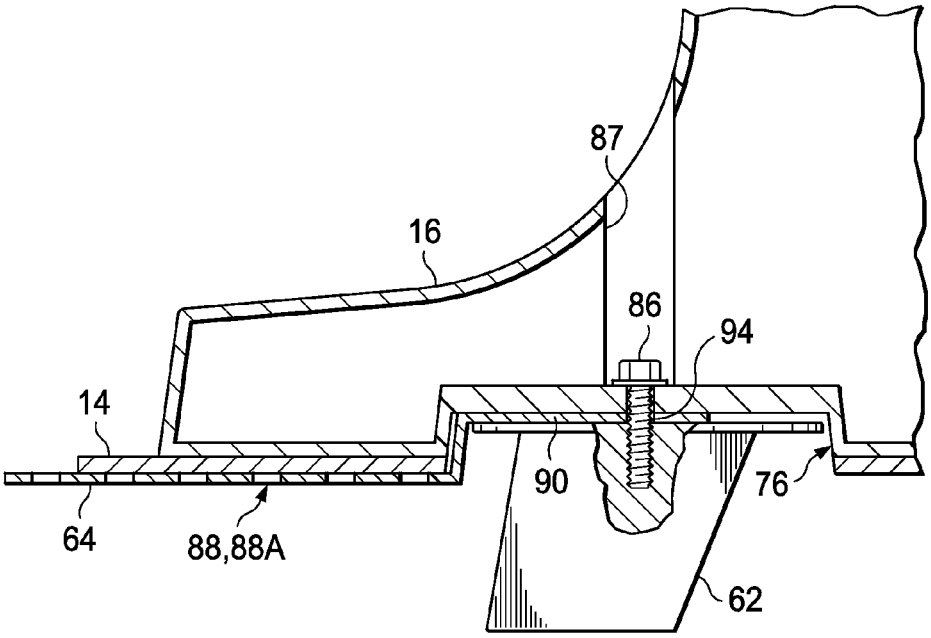
FIG. 20 is a cross-sectional view of the modified tab catch in the tab recess.
Figure 21:
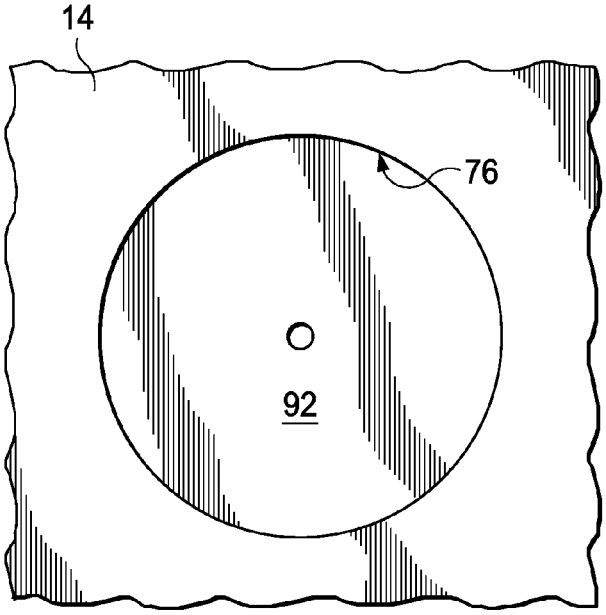
FIG. 21 is a bottom view of an outboard motor showing the tab recess.

With reference to FIGS. 19 and 20, a modified catch 88 will be described. Catch 88 is identical to catch 60 in having bent portion 74 with vertical surface 80 and elongate portion 64 with either slot 66 or holes 68 (only holes 68 are illustrated in the figures) for attachment to the lower element 20 by bolt 70. However, catch 88 has a portion 90 that extends from bent portion 74 along the bottom 92 of the trim tab recess 76 at least as far as the bolt 86. Portion 90 has a hole 94 through which the bolt 86 extends to secure the trim tab 62 in the trim tab recess 76 as seen in FIG. 20. Thus, the catch 88 is securely fastened in the trim tab recess 76 not only by the clamping action of trim tab 62 being secured within the trim tab recess 76 by tightening bolt 86, just as catch 60, but also by the bolt 86 passing through the hole 94 in the catch 88. If, for example, the bolt 86 should loosen in service, reducing the clamping action on the catch 88, the catch 88 will be prevented from slipping out of the trim tab recess 76 by the bolt 86 passing through the hole 94 in the catch 88. Further, while bolt 86 is illustrated as passing down through the motor 16 and plate 14 for threading into the trim tab 62, the catch 88 would work equally well if the design of the outboard motor 16 is such as to have the bolt 86 inserted from below into the trim tab for threading into the motor 16, as is done by certain manufacturers.

The catch 88 is shown having an initial bent portion 74. Alternatively, a catch 88*a*, as seen in FIGS. 19 and 20, can be provided to the boat owner without a bent portion 74 so that the boat owner can bend the catch 88*a* to fit the particular installation. For example, some trim tabs can have an extension which fits into a slot extending further into the motor 16 than the recess 76 and the catch 88*a* would have to be bent to fit around that extension for the bolt 86 to pass through hole 94.

To provide more flexibility, catches 88 and 88*a* can be modified as catches 88*b* and 88*c*, respectively, to have multiple holes 94*a*, 94*b* and 94*c* of different diameters to receive various sizes of bolts 86. For example, Mercury outboards may use a bolt 86 of diameter 7/16 inch, Honda outboards may use a bolt 86 of 10 mm diameter, and Yamaha outboards may use a bolt 86 of 8 mm diameter. Preferably, the smallest diameter hole 94*a* is closest to the elongate portion 64 while the largest diameter hole 94*c* is farthest from the elongate portion 64.

The catches 88 and 88*a*-88*c* can be made of any suitable material, for example of metal or plastic, such as stainless steel, para-aramid synthetic fiber such as sold by Dupont Co. of Wilmington, Del. under the trademark Kevlar, a polyamide such as Nylon or a blend of polyphenylene oxide and polystyrene such as sold by SABIC (Saudi Arabian Basic Industries Corporation) of Saudi Arabia under the trademark Noryl. Further, the catches can be of multiple components bonded or otherwise secured together, such as portion 64 and portion 90 made of a rigid material such as stainless steel connected by a flexible material to form the portion bending over the trim tab. By making the catches 88*a* and 88*c* of suitable flexible and deformable material, such as annealed stainless steel, the tightening of bolt 86 drawing trim tab 62 into the trim tab recess 76 with the catch 88*a* or 88*c* in place can deform the catch 88*a* or 88*c* as needed to conform with the shape of the recess 76 and trim tab 62 to avoid the need to pre-bend the catch before installation.

Figure 22:
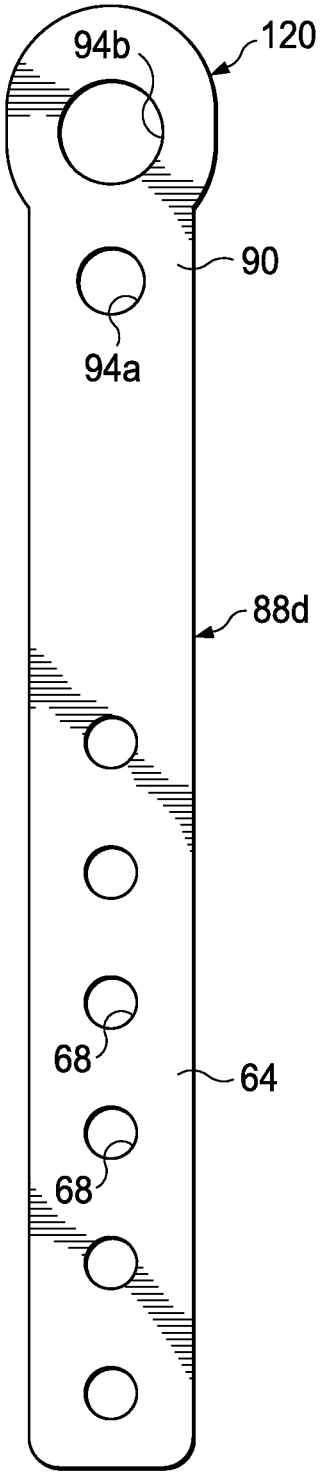
FIG. 22 is a plan view of a modified tab catch.
Figure 23:
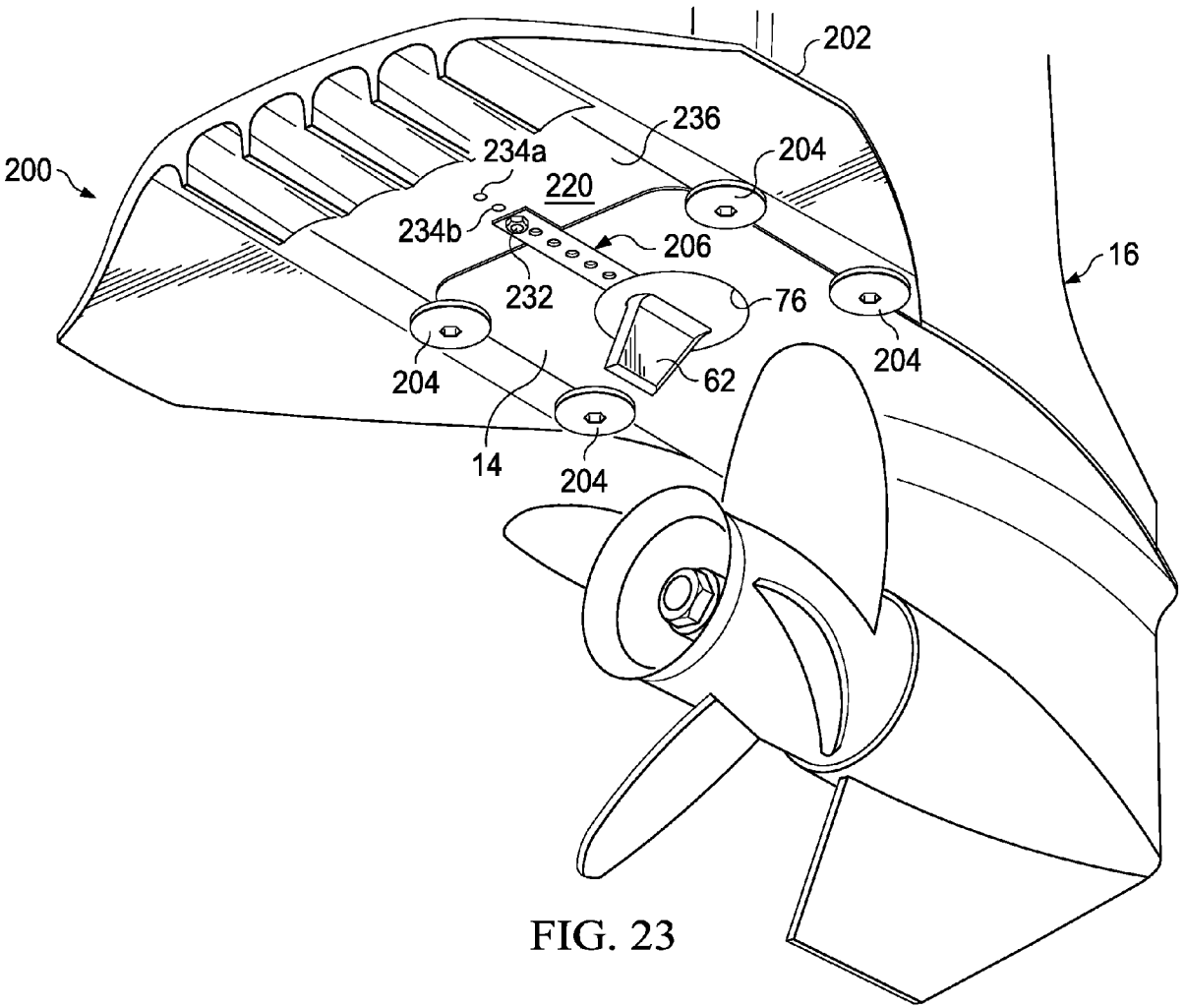
FIG. 23 is a perspective view of a third embodiment of the present invention.

FIG. 22 illustrates a catch 88*d* which is identical to catches 88*a* and 88*c* in not having an initial bent portion 74 and which is other wise used in the identical manner to catches 88, 88*a*, 88*b* and 88*c*. Catch 88*d* is formed of SS-316 annealed stainless steel. This makes catch 88*d* very flexible and provides great elongation strength. Catch 88*d* should conform to any trim tab/anode cavity. In one catch 88*d* constructed in accordance with the teachings of the present invention, the holes 68 are 0.19 inches in diameter and spaced 0.50 inch center to center along elongate portion 64. The smaller hole 94*a* has a diameter of 0.30 inch while the larger hole 94*b* has a diameter of 0.452 inches. The overall length of the catch 88*d* is about 6 inches, the thickness 0.025 inches and the width about ¾ inches except where the catch 88*d* expands out to form an outer circumferential end 120 centered on hole 94*b*. The outer circumferential end 120 provides a substantially constant width of material in catch 88*d* surrounding the hole 94*b* for strength. The smaller hole 94*a* will be used for smaller motors with smaller bolts. To install catch 88*d* on certain Volvo sterndrives, it is recommended to install a 0.25 inch diameter bolt, nut and washers in the factory produced cavitation plate hole (which seldom has a trim tab/anode installed) to facilitate the use of the catch 88*d*.

Thus, four techniques have been disclosed to ensure a secure mounting of the assembly 10 for use on boats, including high speed boats. Any one of these techniques would secure the assembly 10 on the plate 14 alone, but in combination, assure a secure attachment. The four techniques are, as discussed above, (1) Compression of the upper and lower elements, (2) Adhesive foam tape mounted on at least one of the upper and lower elements, (3) Lateral grips (four preferred) with a U-shaped interface mounted on screws to tighten and hold the plate 14 and prevent both horizontal and vertical movement, and (4) the catch that interfaces in the recess of the trim tab/sacrificial anode depression and prevents rearward movement of the assembly 10 at high speeds.

Figure 14:
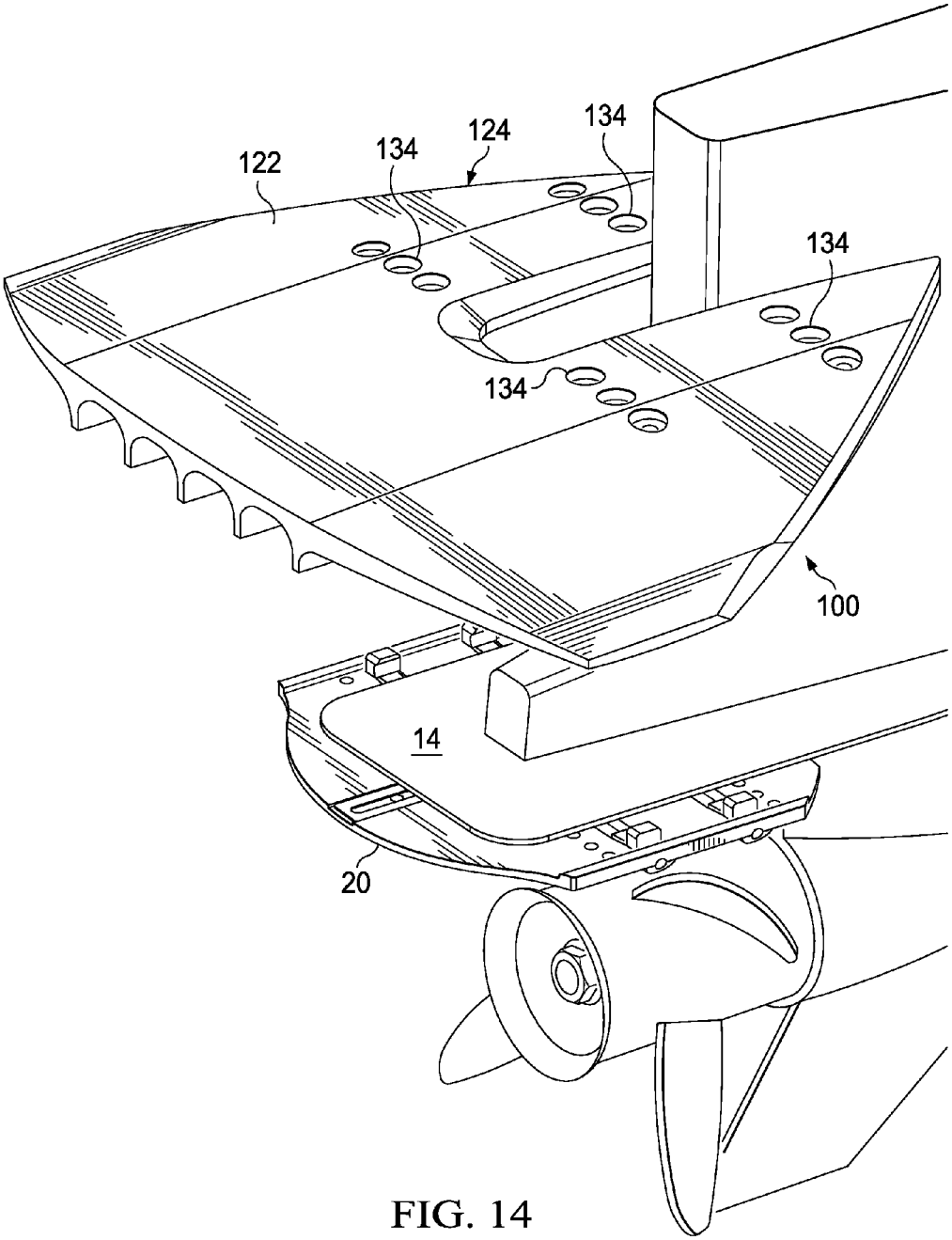
FIG. 14 is an exploded perspective view of a second embodiment of the present invention with the upper element forming a hydrofoil.
Figure 15:
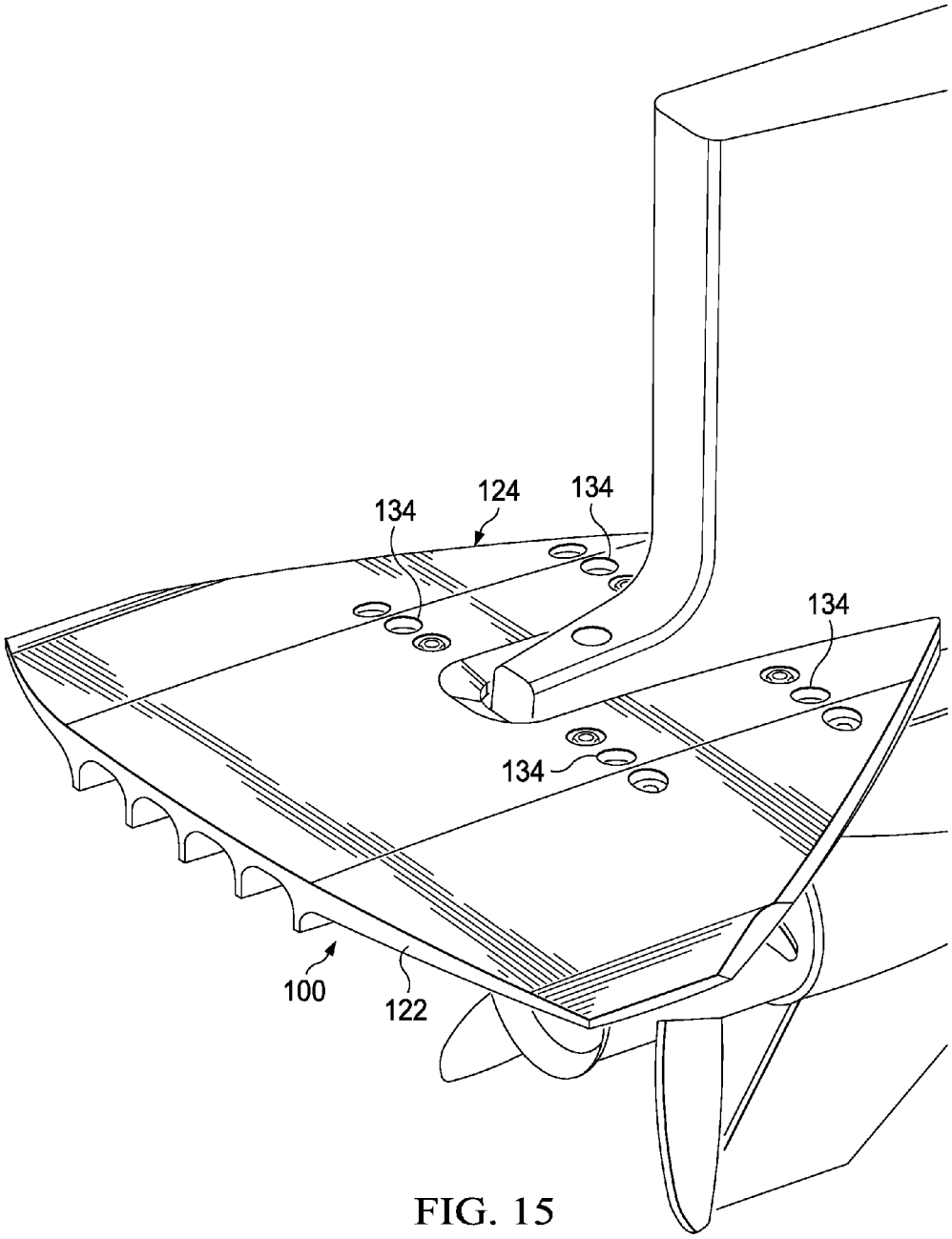
FIG. 15 is a perspective view of the second embodiment of FIG. 14.

With reference now to FIGS. 14 and 15, a second embodiment of the present invention is illustrated forming assembly 100. Assembly 100 uses the identical lower element 20, but has an upper element 122 which actually is formed as a hydrofoil 124. Preferably, the upper element 122 also has a series of inline holes 134 to allow the assembly to be secured to different width plates 14. In all aspects of attachment, the upper and lower elements 122 and 20 of assembly 100 operate the same as upper and lower elements 22 and 20 of assembly 10.

With reference now to FIGS. 23-29, there is illustrated an assembly 200, including a hydrofoil 202, forming a third embodiment of the present invention. The assembly 200 is mounted on the anti-ventilation plate 14 (also commonly called a cavitation plate) of the outboard motor 16 without any need to modify, drill or otherwise permanently change the plate 14 or outboard motor 16. While an outboard motor 16 is shown, the assembly 200 could be used with a sterndrive (inboard/outboard). Further, while assembly 200 is shown to include a hydrofoil, it could also form a trolling motor or a trolling plate extending behind the propeller used to reduce thrust, or other accessory.

The assembly 200 includes a hydrofoil 202 and a series of four mounting disk assemblies 204 which clamp the hydrofoil 202 to the anti-ventilation plate 14. A catch 206 is also secured between the trim tab recess 76 of the plate 14 and the hydrofoil 202.

The hydrofoil 202 can be seen to have dual series of three inline holes 208*a-c* (four or more holes can be used, if desired) on each side thereof that can receive disk assemblies 204 to secure the assembly 200 to the plate 14. The holes 208*a-c* are spaced apart along the width of the hydrofoil 202 for adjustment to different sized plates 14. The hydrofoil 202 would receive disk assemblies 204 in the holes 208 matching just beyond the edges 36 and 38 of plate 14 width. Plate 14 widths of 4, 5, 6 and 7 inches are common, for example.

As seen in FIGS. 25-29, each disk assembly 204 includes a disk 210, a friction material 212 secured to the disk 210, a threaded rod 214 extending from the disk 210 and a nut 216 threaded onto rod 214. The friction material 212 can be rubber, or other suitable material.

In use, the assembly 200 can be preassembled remotely from the plate 14 and motor 16 by initially mounting the disk assemblies 204 on the hydrofoil 202. Each disk assembly 204 is mounted on hydrofoil 202 by inserting the free end 218 of threaded rod 214 in one of the holes 208 from the under side 220 of hydrofoil 202 and threading the nut 216 onto the free end 218 of rod 214 from the top side 222 of the hydrofoil. A disk assembly 204 is mounted in a suitable hole 208 in each of the series of holes on both sides of the hydrofoil 202 for a total of four, as shown in the Figures. This preassembly can be done at any convenient location, such as a work bench.

To mount the assembly 200 on the plate 14, the hydrofoil 202, with the four disk assemblies 204 suspended there from, is slid over the plate 14 from the rear of the motor 16, with the under side 220 of the hydrofoil contacting the top of the plate 14 and the friction material 212 of each of the disk assemblies 204 contacting the under side of the plate 14. When the assembly 200 is in the correct position on plate 14, the nuts 216 on each of the disk assemblies are tightened to draw the friction material 212 against the under side of the plate 14 and clamp the hydrofoil 202 on the plate 14. The preassembly may be most convenient when the plate 14 is in an inconvenient location, such as in shallow water and the like.

The assembly 200 need not be preassembled with the disk assemblies 204 attached to the hydrofoil 202 if desired. The hydrofoil 202 can simply be placed on the top surface of the plate 14, and then the individual disk assemblies 204 can be mounted on hydrofoil 202 and tightened in place.

Figure 25:
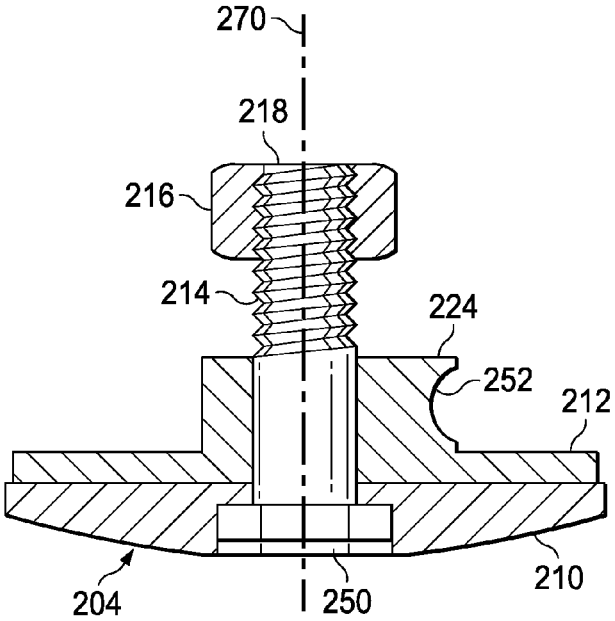
FIG. 25 is a cross sectional view of a mounting disk.
Figure 26:
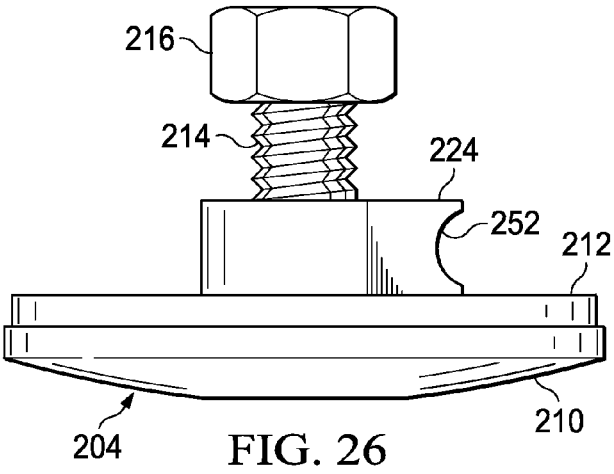
FIG. 26 is a side view of the mounting disk.
Figure 27:
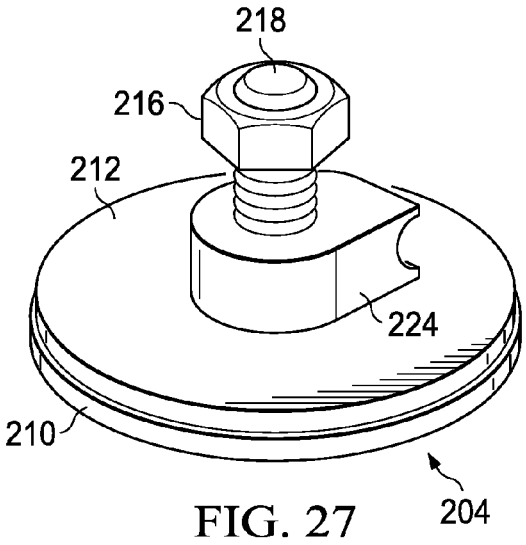
FIG. 27 is a perspective view of the mounting disk.
Figure 28:
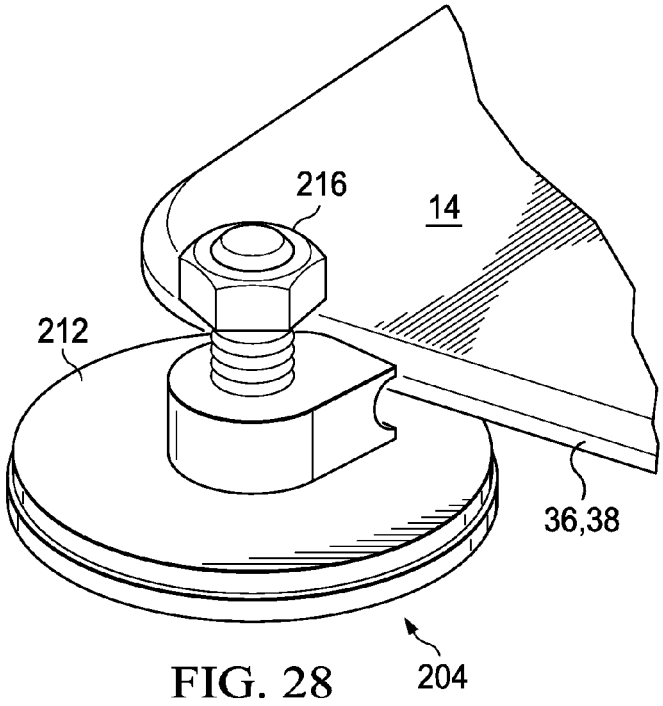
FIG. 28 is perspective view of the mounting disk engaging the edge of an anti-ventilation plate.

The friction material 212 can include a cam extension 224, as seen in FIGS. 25 and 27, which grips the edges 36 and 38 of plate 14 with a cam action. Cam extension 224 has a notched end 252 to better grip the edges 36 and 38. The cam extension 224 can be rotated to fine tune the shaped grip into the plate edges 36 and 38 and then be locked into place when the nut 216 is tightened, suspending the hydrofoil 202 on top of the plate 14. A hex socket 250 is formed in the bottom of disk 210 to assist in setting the proper grip force as the nut 216 is tightened.

The disk assembly 204 can be made of discrete components. For example, disk 210 can be of metal, such as steel or aluminum or plastic such as nylon or polypropylene. Threaded rod 214 and nut 216 can be made of metal, such as steel or aluminum or plastic, such as nylon or polypropylene. The disk 210 and threaded rod 214 can be formed integrally, or be separate components fixed together. Friction material 212 and cam extension 224 can be rubber or a high friction plastic and can be bonded to disk 210 or molded about disk 210. Alternatively, the disk 210, friction material 212, rod 214, and cam extension 224 can be in integral form. It is important for the cam extension 224 to be fixed relative the hex socket 250 in the disk assembly 204 so that a wrench can be inserted in the socket 250 to rotate the disk assembly about the elongate axis 270 of the threaded rod 214 to tightly grip the plate edge 36 or 38 with cam extension 224 as the nut 216 is being tightened. This provides dual clamping forces generally perpendicular each other. The first clamping force is formed by tightening nut 216 on threaded rod 214 to clamp the bottom of the hydrofoil 202 against the top of the plate 14 and the friction material 212 against the bottom of the plate 14, the plate 14 being clamped there between. The second force is formed generally perpendicular the first force by forcing the cam extension 224 against the plate edge 36 or 38 to grip the edge as the nut 216 is tightened.

Figure 24:
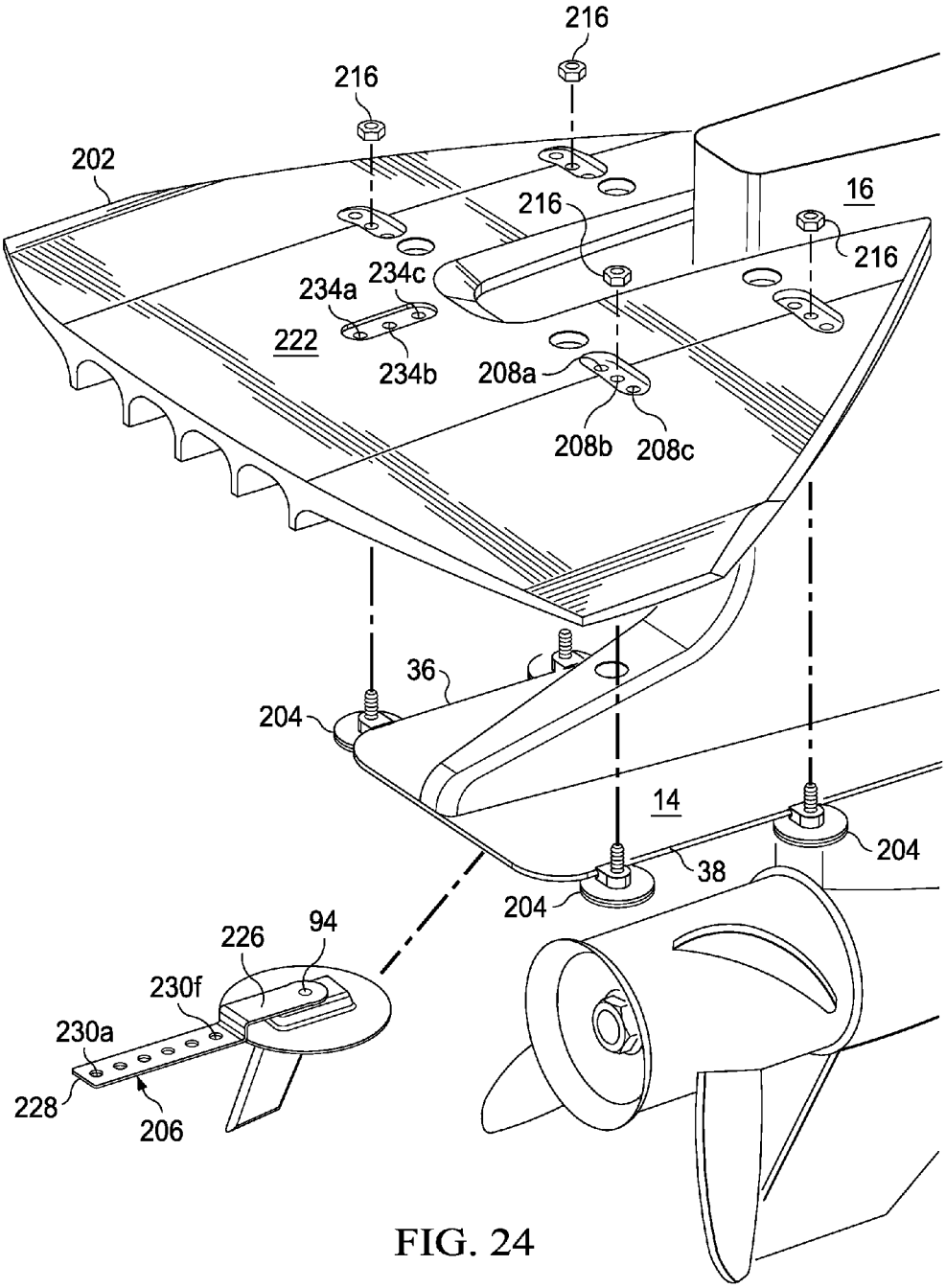
FIG. 24 is an exploded view of the third embodiment.
Figure 29:
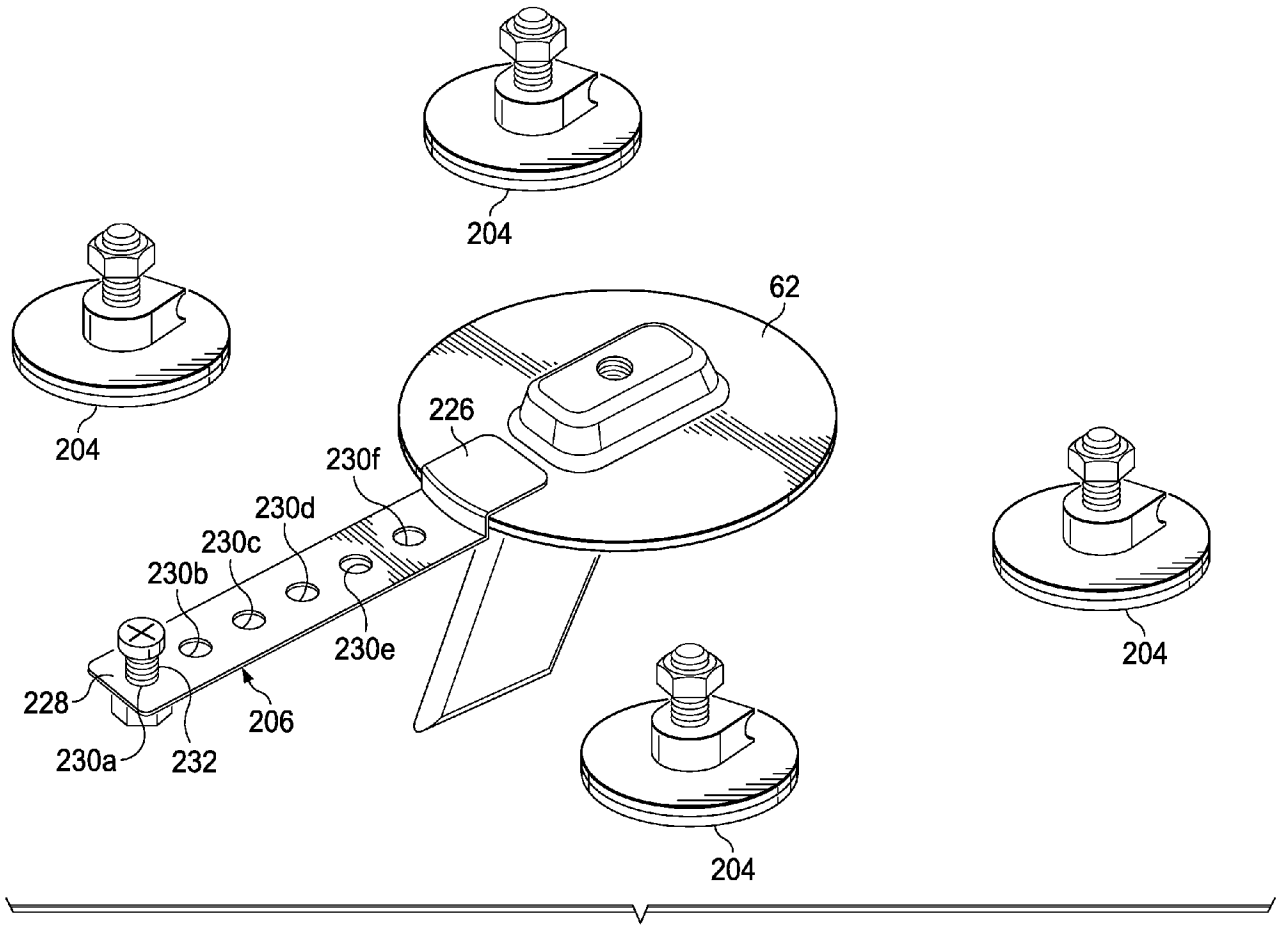
FIG. 29 is an illustration of the mounting disks and catch used to mount a foil.
Figure 30:
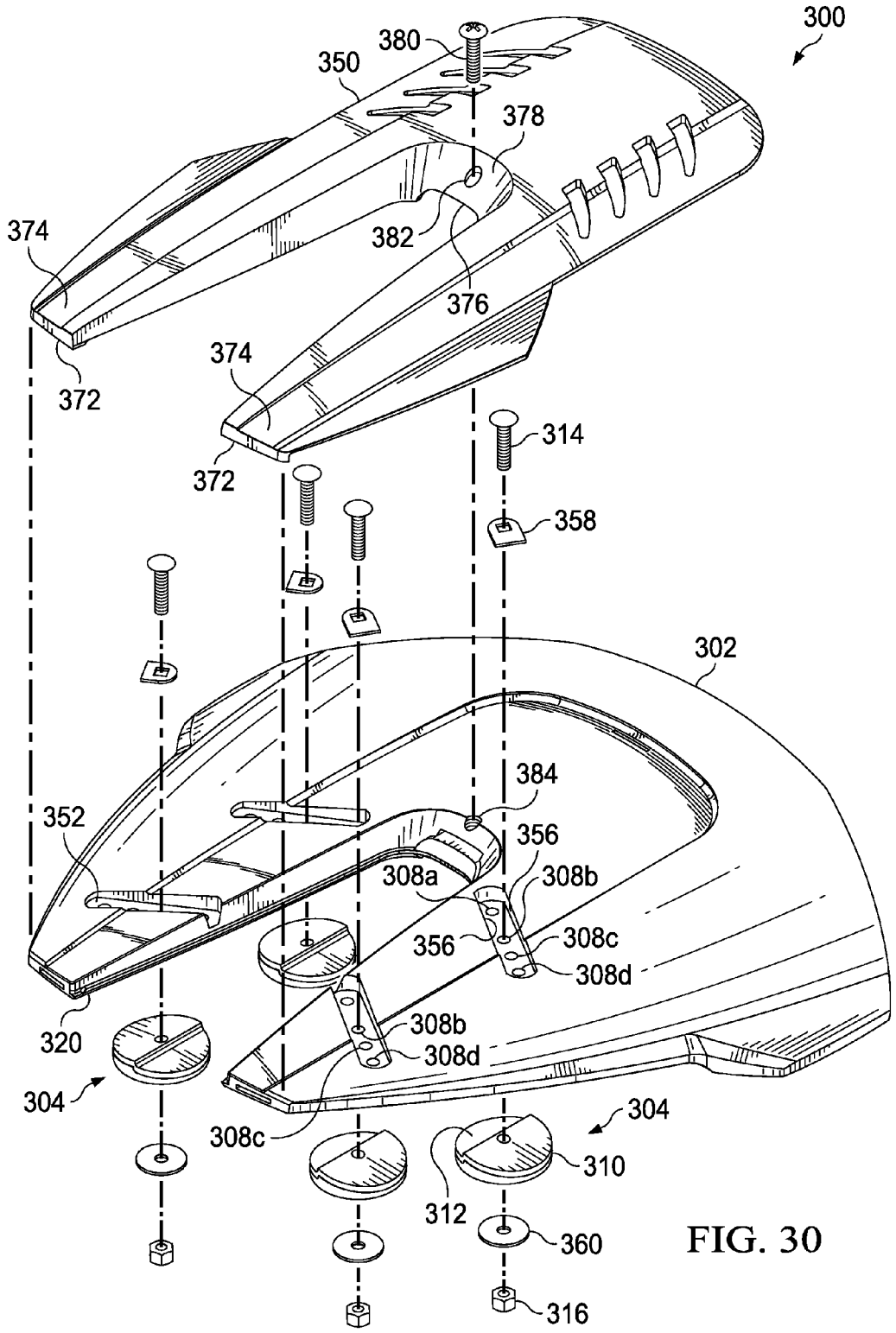
FIG. 30 is an exploded perspective view of a fourth embodiment of the present invention.
Figure 31:
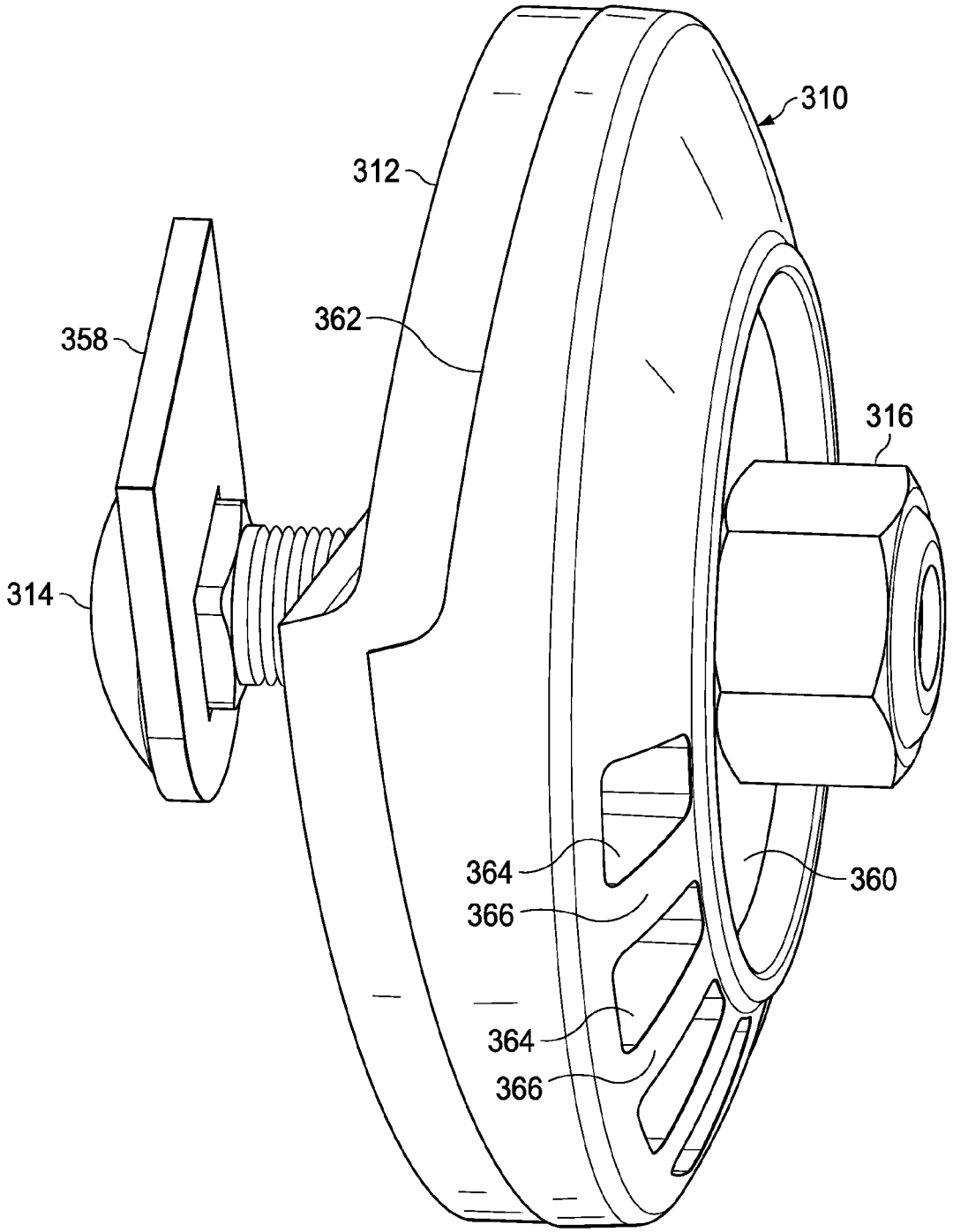
FIG. 31 is a perspective view of the mounting disk assembly used in the fourth embodiment.
Figure 32:
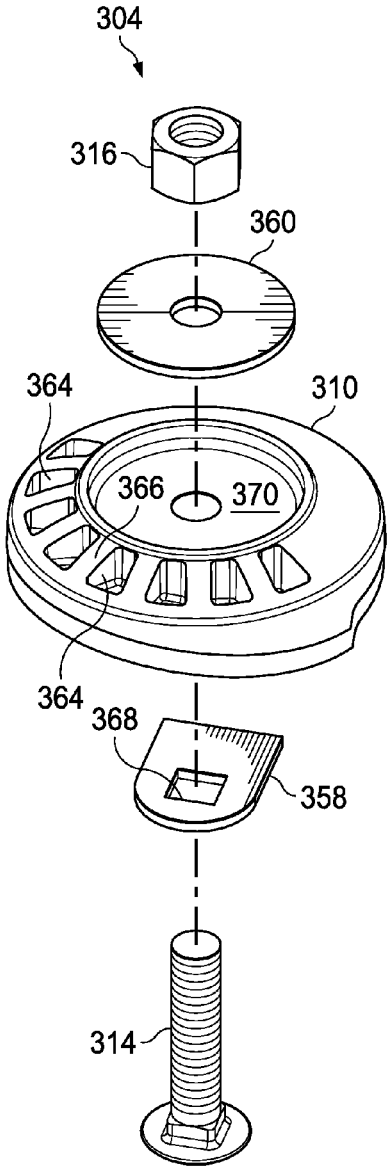
FIG. 32 is an exploded view of the mounting disk assembly.
Figure 33:
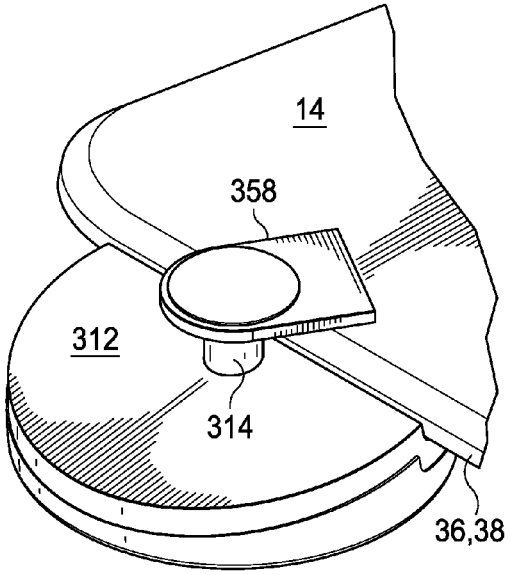
FIG. 33 is an illustration of the mounting disk assembly engaging the anti-ventilation plate.

The catch 206 can be mounted between the trim tab recess 76 and the hydrofoil 202. Catch 206 can be identical to any of the catches 60, 88, 88*a*, 88*b*, 88*c* or 88*d* previously described. More specifically, the end 226 of catch 206 is secured in the trim tab recess 76 by any of the techniques mentioned above with regard to catches 60, 88, 88*a*, 88*b*, 88*c* or 88*d*. For example, the end 226 can have a hole 94 to receive the trim tab bolt 86 as shown in FIG. 24 or be similar to the bent portion 74, as seen in FIG. 29. The opposite end 228 of catch 206 has a series of holes 230*a-f* to receive a bolt 232 to secure the end 228 to one of a series of holes 234*a-c* in the center area 236 of the hydrofoil 202. The assembly 200 is thus kept in place and prevented from moving rearward by the catch 206. The number of holes 230 and 234 are to provide maximum flexibility in adapting the assembly 200 to the widest range of motors 16 possible.

The use of multiple holes 208 along the width of the hydrofoil provides maximum flexibility in installing the assembly 200 on plates 14 of different widths, 5, 6, and 7 inch wide, for example. The holes 208 nearest the edges 36 and 38 are selected to receive disk assemblies 204 to provide the maximum friction engagement between the disk assemblies 204 and the plate 14 as possible.

With reference now to FIGS. 30-33, there is illustrated an assembly 300, including a hydrofoil or device 302, forming a fourth embodiment of the present invention. The assembly 300 is mounted on the anti-ventilation plate 14 (also commonly called a cavitation plate) of the outboard motor 16 without any need to modify, drill or otherwise permanently change the plate 14 or outboard motor 16. The assembly 300 could also be used with a sterndrive (inboard/outboard). Further, while assembly 300 is shown to include a hydrofoil, it could also form a trolling motor or a trolling plate extending behind the propeller used to reduce thrust, or other accessory.

The assembly 300 includes a hydrofoil 302, a cover 350 and a series of four mounting disk assemblies 304 which clamp the hydrofoil 302 to the anti-ventilation plate 14. A catch 206 (not shown) can also be secured between the trim tab recess 76 of the plate 14 and the hydrofoil 302.

The hydrofoil 302 can be seen to have dual series of four inline holes 308*a-d* (fewer or more holes can be used, if desired) on each side thereof that can receive disk assemblies 304 to secure the assembly 300 to the plate 14. The holes 308*a-d* are spaced apart along the width of the hydrofoil 302 for adjustment to different sized plates 14. The hydrofoil 302 would receive disk assemblies 304 in the holes 308 matching just beyond the edges 36 and 38 of plate 14 width. Plate 14 widths of 4, 5, 6 and 7 inches are common, for example.

The holes 308*a-d* lie within recesses 352 formed in the top of the hydrofoil 302, as shown. The recesses 352 are formed with parallel walls 356.

As seen in FIGS. 30-33, each disk assembly 304 includes a disk 310, a friction material 312 secured to the disk 310, a carriage bolt 314, D-shaped washer 358, a nut 316 and a conventional washer 360. As can been seen, each disk 310 has a step 362 formed therein. The step 362 helps align the disk 310 relative the edges 36 and 38 of the plate 14 and will help secure the assembly 300 from moving side to side on the plate 14. The disks 310 also have a series of recesses 364 on the bottom thereof to form spokes 366. These are for the purpose of reducing plastic mass in the thickest area of the disk 310 and make the molding process more even and avoid shrinkage in the plastic as the disks are cooled after molding. The spokes 366 also add a structural benefit by forming a bridging element. The friction material 312 is preferably rubber about ⅛ inch thick. The friction material 312 can be hand glued to the disk 310 or in-molded to the disk 310.

In use, the assembly 300 can be preassembled remotely from the plate 14 and motor 16 by initially mounting the disk assemblies 304 on the hydrofoil 302, if desired. Each disk assembly 304 is mounted on hydrofoil 302 by positioning the D-shaped washer 358 in recess 352 over the hole 308*a-d* selected to mount the disk assembly 304. The D-shaped washer 358 nests in the recess 352 in contact with the walls 356 of the recess so the washer 358 can't rotate in the recess. As shown, the D-shaped washer 358 has a square hole 368 therein which engages the square shoulder of the carriage bolt 314 as it is inserted from the top of the hydrofoil 302 into the particular hole 308*a-d* to be used. When inserted, the carriage bolt 314 can't rotate about its elongate axis as it engages the D-shaped washer 358, which, in turn, engages the walls 356.

The disk 310 and conventional washer 360 can then be placed over the free end of the carriage bolt 314 extending below the hydrofoil 302 and nut 316 threaded onto the carriage bolt 314. A recess 370 can be formed in the bottom of the disk 310 to receive the washer 360 (or multiple washers) which adds to the strength of the disk 310. A disk assembly 304 is mounted in a suitable hole 308 in each of the series of holes on both sides of the hydrofoil 302 for a total of four, as shown in the Figures. This preassembly can be done at any convenient location, such as a work bench.

To mount the assembly 300 on the plate 14, the hydrofoil 302, with the four disk assemblies 304 suspended there from, is slid over the plate 14 from the rear of the motor 16, with the under side 320 of the hydrofoil contacting the top of the plate 14 and the friction material 312 of each of the disk assemblies 304 contacting the under side of the plate 14. When the assembly 300 is in the correct position on plate 14, the disks on each of the disk assemblies are rotated so the steps 362 engage the bottom of the plate 14 and the nuts 316 are tightened to draw the friction material 312 against the under side of the plate 14 and clamp the hydrofoil 302 on the plate 14. The preassembly may be most convenient when the plate 14 is in an inconvenient location, such as in shallow water and the like.

The use of the D-shaped washers 358, which prevent carriage bolts 314 from rotating as the nuts 316 are tightened to secure, align and compress the disks 304 against the edges of the plate 14, allows the assembly 300 to be installed with only one wrench. Further, the disk assemblies 304 can be tightened and retightened as needed using only a single wrench.

The assembly 300 need not be preassembled with the disk assemblies 304 attached to the hydrofoil 302 if desired. The hydrofoil 302 can simply be placed on the top surface of the plate 14, and then the individual disk assemblies 304 can be mounted on hydrofoil 302 and tightened in place.

After the hydrofoil 302 has been mounted on the plate 14, the cover 350 can be secured on the hydrofoil 302 to cover the recesses 352 and the ends of the carriage bolts 314 to provide a more pleasing appearance and provide a more streamlined configuration. The cover 350 has interlocks 372 on the front ends 374 and interlock 376 on the yoke 378 to snap fit on matching structures on the hydrofoil 302 to hold the cover 350 in place. A screw 380 also secures the cover 350 to the hydrofoil 302. The screw 380 is inserted in hole 382 in cover 350 and threaded into threaded aperture 384 in hydrofoil 302. The use of D-shaped washers 358, which prevent the carriage bolts 314 from rotating about their elongate axis, allows the assembly 300 to be easily retightened later without having to remove the cover 350 as the nuts 316 can be readily tightened from the bottom side of the hydrofoil 302 with the assembly 300 installed on the plate 14.

The disk assembly 304 can be made of discrete components. For example, disk 310 can be of metal, such as steel or aluminum or plastic such as nylon or polypropylene. Carriage bolt 314 and nut 316 can be made of metal, such as steel or aluminum or plastic, such as nylon or polypropylene. Friction material 312 can be rubber or a high friction plastic and can be bonded to disk 310 or molded about disk 310. Alternatively, the disk 310 and friction material 312 can be in integral form.

A catch 206 can be mounted between the trim tab recess 76 and the hydrofoil 302. Catch 206 can be identical to any of the catches 60, 88, 88*a*, 88*b*, 88*c* or 88*d* previously described. More specifically, the end 226 of catch 206 is secured in the trim tab recess 76 by any of the techniques mentioned above with regard to catches 60, 88, 88*a*, 88*b*, 88*c* or 88*d*. For example, the end 226 can have a hole 94 to receive the trim tab bolt 86 as shown in FIG. 24 or be similar to the bent portion 74, as seen in FIG. 29. The opposite end 228 of catch 206 has a series of holes 230*a-f* to receive a bolt 232 to secure the end 228 to one of a series of holes 234*a-c* in the center area 236 of the hydrofoil 202. The assembly 200 is thus kept in place and prevented from moving rearward by the catch 206. The number of holes 230 and 234 are to provide maximum flexibility in adapting the assembly 200 to the widest range of motors 16 possible.

The use of multiple holes 308 along the width of the hydrofoil 302 provides maximum flexibility in installing the assembly 300 on plates 14 of different widths, 5, 6, and 7 inch wide, for example. The holes 308 nearest the edges 36 and 38 are selected to receive disk assemblies 304 to provide the maximum friction engagement between the disk assemblies 304 and the plate 14 as possible.

As can be understood, the assemblies 10, 100, 200 and 300 provide a method for attaching a one piece hydrofoil to the anti-ventilation plate 14 of a boat without the need to drill attachment holes in the boat engine. The assemblies will function with a range of plate widths and fit tightly on the plate. Only simple tools are needed to install the assemblies and hydrofoil and the operation is sufficiently straightforward for the typical boat owner to undertake the installation.

While several embodiments of the present invention have been illustrated in the accompanying drawings and described in the foregoing Detailed Description, it will be understood that the invention is not limited to the embodiments disclosed, but is capable of numerous rearrangements, modifications and substitutions of parts and elements without departing from the scope and spirit of the invention.

The invention claimed is:

1. An assembly for mounting to a plate on a marine component, the plate having edges and a trim tab recess, comprising:

a first device;

at least one mounting disk assembly having a mounting disk with a step and a friction surface engaging the plate, the at least one mounting disk assembly further having a bolt to clamp the first device and the at least one mounting disk assembly to the plate at an edge of the plate; and a catch secured to the first device and to the plate by the catch engaging the trim tab recess to further mount the assembly to the plate.

2. The assembly of claim 1 wherein the first device is a hydrofoil.

3. The assembly of claim 1 wherein the bolt is a carriage bolt, the first device having a recess with parallel walls, the at least one mounting disk assembly further having a D-shaped washer received in the recess, the carriage bolt engaging the D-shaped washer to prevent the carriage bolt from rotating about its elongate axis.

4. The assembly of claim 1 wherein the first device has a width and a first side and a second side, a series of apertures formed through the first device along the width thereof on each side of the first device, each aperture in the series of apertures suitable for receiving a mounting disk assembly, a mounting disk assembly received in the aperture in each of the series of apertures closest to the edge of the plate.

5. The assembly of claim 1 further comprising a cover fit onto the first device to conceal an end of the bolt.

6. The assembly of claim 1 wherein the catch has a bent portion to engage the trim tab recess, the catch being adjustably mounted on the first device.

7. The assembly of claim 1 wherein the marine component has a bolt to secure a trim tab in the trim tab recess, the catch having a hole to receive the bolt.

8. The assembly of claim 1 wherein the catch has a plurality of holes to permit the catch to be used with marine components of different configurations.

9. The assembly of claim 8 wherein the plurality of holes each have a different diameter.

10. The assembly of claim 1 wherein the plate is an anti-ventilation plate on an inboard or outboard motor.

11. The assembly of claim 1 wherein the catch is made of stainless steel.

12. The assembly of claim 1 wherein the mounting disk has a recess to receive a conventional washer.

13. The assembly of claim 1 wherein the friction surface is made of rubber.

14. The assembly of claim 1 wherein the plate has a first edge and a second edge, said assembly having four mounting disk assemblies, two engaging each edge of the plate.

15. An assembly for mounting to a plate on a marine component, the plate having a first edge and a second edge and a trim tab recess, comprising:

a hydrofoil, said hydrofoil having a first side and a second side and a predetermined width, said hydrofoil further having first and second sets of apertures on each side, each of the sets of apertures having at least two apertures spaced along the width of the hydrofoil;

a mounting disk assembly secured to the hydrofoil in each of the sets of apertures on both sides of the hydrofoil at the aperture in each of the sets lying just beyond the edge of the plate, each mounting disk assembly having a mounting disk with a step and a friction surface engaging the plate, a bolt extending from an aperture in the hydrofoil and through the disk and a nut engaging the bolt to clamp the hydrofoil and each mounting disk assembly to the plate at an edge of the plate.

16. The assembly of claim 15 wherein the assembly further has a cover to engage the hydrofoil to conceal an end of the bolt, and a catch secured to the hydrofoil at a first end thereof and to the plate at a second end thereof, the second end of the catch engaging the trim tab recess to further mount the assembly to the plate.

17. The assembly of claim 15 wherein the bolt is a carriage bolt, each mounting disk assembly further having a D-shaped washer engaging the hydrofoil and carriage bolt to prevent the carriage bolt from rotating about its elongate axis.

18. The assembly of claim 15 wherein the friction surface is made of rubber.

19. A method of mounting an assembly on a plate, the plate having a first edge and a second edge, the plate mounted on a marine component, comprising the steps of:

positioning a hydrofoil on the plate, the hydrofoil having a first side and a second side and a predetermined width, first and second sets of apertures formed in the hydrofoil in each side thereof;

positioning a mounting disk assembly in the aperture closest to the edge of the plate in each set of apertures on both sides of the hydrofoil, each mounting disk assembly having a mounting disk with a step and a friction surface for engaging the plate, and a threaded member extending from the aperture closest to the edge of the plate in the hydrofoil, each mounting disk assembly further having a threaded element engaging the threaded member;

clamping the hydrofoil to the plate with the mounting disk assemblies by tightening the threaded element onto the threaded member of each mounting disk assembly; and securing a catch between the hydrofoil and the plate.

* * * * *